US008941703B2

(12) United States Patent
Oshiro

(10) Patent No.: US 8,941,703 B2
(45) Date of Patent: Jan. 27, 2015

(54) PRINTING APPARATUS

(71) Applicant: Yasutake Oshiro, Yamanashi-ken (JP)

(72) Inventor: Yasutake Oshiro, Yamanashi-ken (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 0 days.

(21) Appl. No.: 14/221,976

(22) Filed: Mar. 21, 2014

(65) Prior Publication Data

US 2014/0285608 A1 Sep. 25, 2014

(30) Foreign Application Priority Data

Mar. 25, 2013 (JP) ..... 2013-062551

(51) Int. Cl.
*B41J 2/35* (2006.01)
*B41J 2/355* (2006.01)

(52) U.S. Cl.
CPC ..... *B41J 2/355* (2013.01)
USPC ..... 347/211

(58) Field of Classification Search
USPC ..... 347/211, 214, 215, 217–219, 180–182
See application file for complete search history.

(56) References Cited

U.S. PATENT DOCUMENTS

| | | | | |
|---|---|---|---|---|
| 5,786,839 | A * | 7/1998 | Itoh | 347/211 |
| 8,004,548 | B2 * | 8/2011 | Muraki et al. | 347/211 |
| 8,736,649 | B2 * | 5/2014 | Caporossi et al. | 347/211 |
| 2012/0194627 | A1 * | 8/2012 | Caporossi et al. | 347/180 |

FOREIGN PATENT DOCUMENTS

JP 5093283 B2 12/2012

* cited by examiner

*Primary Examiner* — Kristal Feggins
(74) *Attorney, Agent, or Firm* — Manabu Kanesaka

(57) ABSTRACT

To provide a printing apparatus for enabling printing speed to be increased, while enabling the unevenness of concentration to be reduced, a printing apparatus is provided with a thermal head having a plurality of heater elements lined up in the main scanning direction and a CPU for switching current passage timing of the plurality of heater elements, and the CPU switches the current passage timing for the plurality of heater elements so that a second strobe signal STB2 is switched to an ON state after switching a first strobe signal STB1 to an ON state, after switching the STB2 to the ON state the STB1 is switched to an OFF state, the STB2 is switched to an OFF state, then the STB1 is switched to the ON state after switching the STB2 to the ON state, after switching the STB1 to the ON state the STB2 is switched to the OFF state, and that the STB1 is switched to the OFF state.

6 Claims, 25 Drawing Sheets

PRINTING APPARATUS

TECHNICAL FIELD

The present invention relates to a printing apparatus, and more particularly, to a printing apparatus that performs printing processing on a recording medium with a thermal head via an ink ribbon.

BACKGROUND ART

Conventionally, such a printing apparatus has been known widely that forms an image such as a photograph of face and character information on a printing medium such as a plastic card. This type of printing apparatus uses a direct printing scheme for directly forming an image on a recording medium with a thermal head via an ink ribbon, or uses an indirect printing scheme for forming an image (mirror image) on a transfer film with a thermal head via an ink ribbon, and next transferring the image formed on the transfer film to a recording medium.

Generally, in the case of performing printing processing using a thermal head, in order to reduce the capacity of power supply voltage, reserve stability (prevent a voltage drop) of power supply voltage, reduce the size of the thermal head, etc., the current passage start timing is provided with a time difference so that the passage of current for each strobe applied (input) to the thermal head does not coincide with each other. Each heater element of the thermal head is comprised of a resistor, and the current (energy amount) passing through each heater resistor is of I(current)=V(voltage)/R (resistance). Further, a voltage drop occurs in the power supply voltage due to a large current in passing the current through the thermal head.

For example, Patent Document 1 discloses techniques for providing a heating period and a non-heating period, dividing the period into the side closer to the start and the side closer to the end of a printing cycle, keeping the temperature for a chopping current passage period closer to the end during a heating time closer to the start, and thereby reducing withstand voltage or withstand capacity to improve printing speed.

In other words, in the techniques of Patent Document 1, as shown in FIG. 21, with respect to printing processing of the first printing line, at time t1 a first strobe signal STB1 is switched from an OFF state to an ON state, at time t2 the first strobe signal STB1 is switched to the OFF state, while a second strobe signal STB2 is switched from an OFF state to an ON state, at time t3 the second strobe signal STB2 is switched to the OFF state, the same current passage control is performed on the printing processing of the second and subsequent printing lines, the passage of current through the heater elements with the first strobe signal STB1 and second strobe signal STB2 is not performed at the same time, and the energy amount is thereby suppressed to reduce withstand capacity.

PRIOR ART DOCUMENT

Patent Document

[Patent Document 1] Japanese Patent Gazette No. 5093283 (see FIG. 8)

DISCLOSURE OF INVENTION

Problems to be Solved by the Invention

Meanwhile, in this type of printing apparatus, in recent years, it has been particularly required to increase speed of printing, and as the measures, it is effective to decrease a time difference in current passage start timing. For example, as shown in FIG. 22, it is conceivable that with respect to printing processing of the first printing line, at time t1 the first strobe signal STB1 is switched from an OFF state to an ON state, at time t2 the second strobe signal STB2 is switched from an OFF state to an ON state, at time t3 the first strobe signal STB1 is switched to the OFF state, at time t4 the second strobe signal STB2 is switched to the OFF state (the passage of current through the heater elements with the first strobe signal STB1 and second strobe signal STB2 is performed at the same time for a period of time t2 to time t3 ), and that the same current passage control is performed on the second and subsequent printing lines.

However, when the current passage control as shown in FIG. 22 is performed, although the printing speed is increased, there is a problem that the unevenness of concentration occurs. In other words, at the time the first strobe signal STB1 is switched to the ON state at time t1, a voltage drop occurs in thermal head applied voltage Vhead (power supply voltage), and when the second strobe signal STB2 is switched to the ON state (at time t2) after the thermal head applied voltage Vhead due to the voltage drop, since a further voltage drop is made in the thermal head applied voltage Vhead, a difference occurs in the current (energy amount). As a result, the energy loss is larger in the first strobe signal STB1 than in the second strobe signal STB2 during printing of the first printing line.

FIG. 20A schematically shows a printing state of the first to fourth printing lines with eight (R1 to R8) heater elements among heater elements lined up in the main scanning direction in the case of performing the current passage control as shown in FIG. 22. Image formation by heater elements (R2, R4, R6, R8) driven with the second strobe signal STB2 is thicker than image formation by heater elements (R1, R3, R5, R7) driven with the first strobe signal STB1, and the unevenness of concentration occurs.

In view of the above-mentioned matter, it is an object of the present invention to provide a printing apparatus for enabling printing speed to be increased, while enabling the unevenness of concentration to be reduced.

Means for Solving the Problem

To attain the above-mentioned object, the present invention is characterized in that a printing apparatus for performing printing processing on a recording medium with a thermal head via an ink ribbon is provided with a thermal head having a plurality of heater elements lined up in a main scanning direction and current passage control means for switching current passage timing of the plurality of heater elements, and that the current passage control means controls a first strobe signal for switching between ON and OFF of passage of current through a part of the plurality of heater elements and a second strobe signal for switching between ON and OFF of passage of current through the other part of the plurality of heater elements, so that current passage time periods for switching passage of current through the part and the other part of the plurality of heater elements to an ON state partially overlap and that in printing data of a same concentration over a plurality of lines with the part of the plurality of heater elements and the other part of the plurality of heater elements, a sum of an integrated value of current passed through the part of the plurality of heater elements in printing processing of an odd-numbered printing line and an integrated value of current passed through the part of the plurality of heater elements in printing processing of an even-numbered printing line is the same as a sum of an integrated value of current passed through the other part of the plurality of heater elements in printing processing of the odd-numbered printing line and an integrated value of current passed through the other part of the plurality of heater elements in printing processing of the even-numbered printing line.

In the invention, the current passage control means may control the first strobe signal and the second strobe signal so that current passage start timing for switching passage of current through the part and the other part of the plurality of heater elements to the ON state is temporally different completely from current passage end timing for switching passage of current through the part and the other part of the plurality of heater elements to an OFF state. Further, the plurality of heater elements is comprised of a plurality of blocks divided in the main scanning direction, and the current passage control means may control passage of current through heater elements of an odd-numbered block at the same timing as the first strobe signal, while controlling passage of current through heater elements of an even-numbered block at the same timing as the second strobe signal.

Further, the current passage control means may switch the current passage timing for the part and the other part of the plurality of heater elements so that the second strobe signal is switched to the ON state after switching the first strobe signal to the ON state, after switching the second strobe signal to the ON state the first strobe signal is switched to the OFF state, the second strobe signal is switched to the OFF state, then the first strobe signal is switched to the ON state after switching the second strobe signal to the ON state, after switching the first strobe signal to the ON state the second strobe signal is switched to the OFF state, and that the first strobe signal is switched to the OFF state.

Furthermore, the first strobe signal and the second strobe signal may have a plurality of current passage pulses to switch passage of current through the part and the other part of the plurality of heater elements to the ON state for printing processing of one printing line.

Then, the first strobe signal and the second strobe signal have a plurality of current passage pulses to switch passage of current through the part and the other part of the plurality of heater elements to the ON state for printing processing of one printing line, and the current passage control means may control so that the strobe signal to which a current passage pulse that is first switched to the ON state belongs is different between the first strobe signal and the second strobe signal for each printing line.

Advantageous Effect of the Invention

According to the present invention, the current passage control means controls the first and second strobe signals so that time periods of passage of current through a part and the other part of a plurality of heater elements partially overlap, it is thereby possible to increase the speed of printing, while in the case of printing data of the same concentration over a plurality of lines with the part of the plurality of heater elements and the other part of the plurality of heater elements, the control means controls so that a sum of an integrated value of current passed through the part of the plurality of heater elements in printing processing of an odd-numbered printing line and an integrated value of current passed through the part of the plurality of heater elements in printing processing of an even-numbered printing line is the same as a sum of an integrated value of current passed through the other part of the plurality of heater elements in printing processing of the odd-numbered printing line and an integrated value of current passed through the other part of the plurality of heater elements in printing processing of the even-numbered printing line, and it is thereby possible to obtain the effect of reducing the occurrence of unevenness of concentration caused by a voltage drop of the power supply voltage.

MODE FOR CARRYING OUT THE INVENTION (Embodiment 1)

Described below is Embodiment 1 in which the present invention is applied to a printing apparatus for printing and recording text and image on a card (recording medium), while performing magnetic or electric information recording on the card.

<System Configuration>

Figure 1:
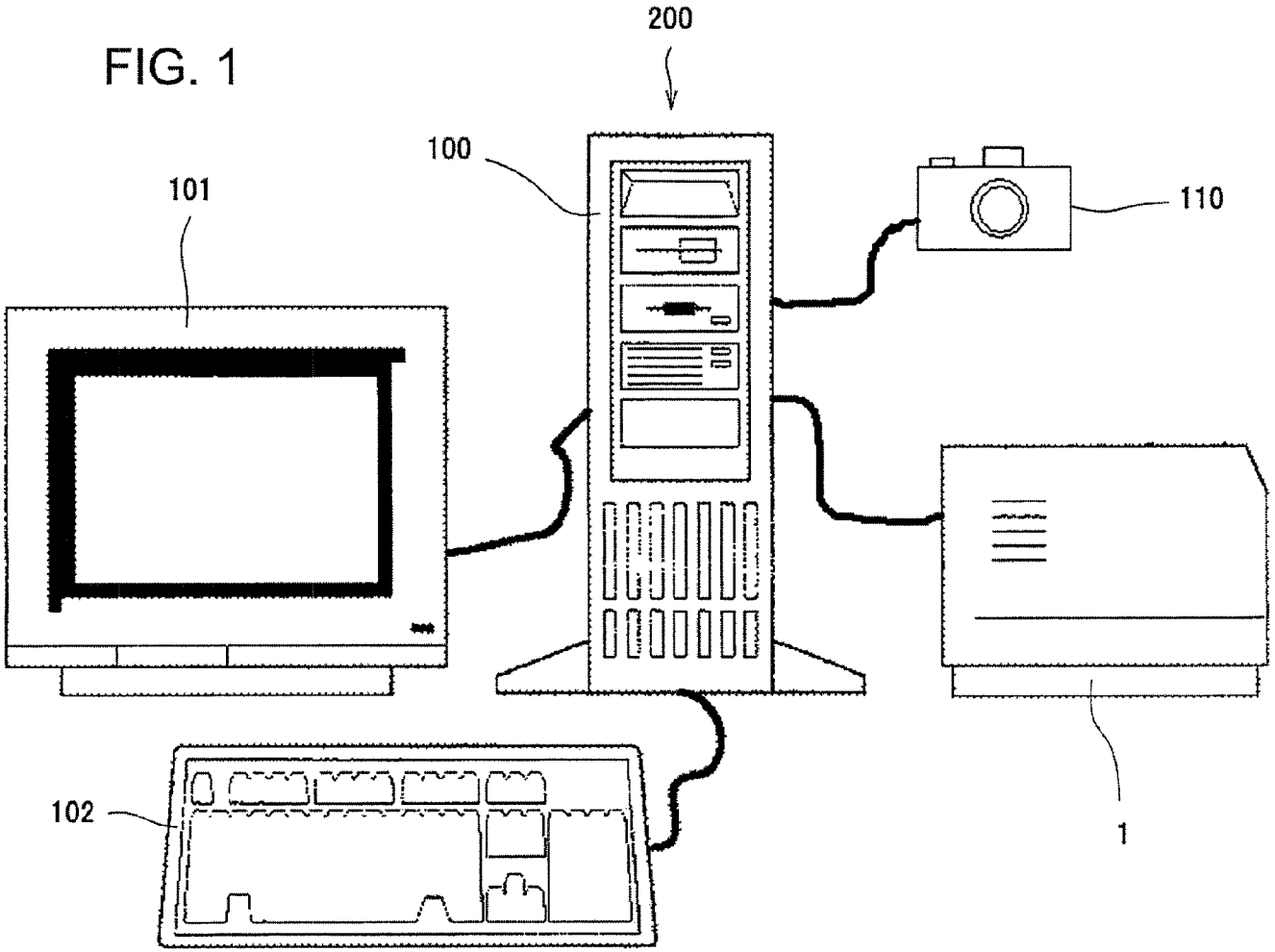
FIG. 1 is an outside view of a printing system including a printing apparatus of Embodiment 1 to which the present invention is applicable.
Figure 12:
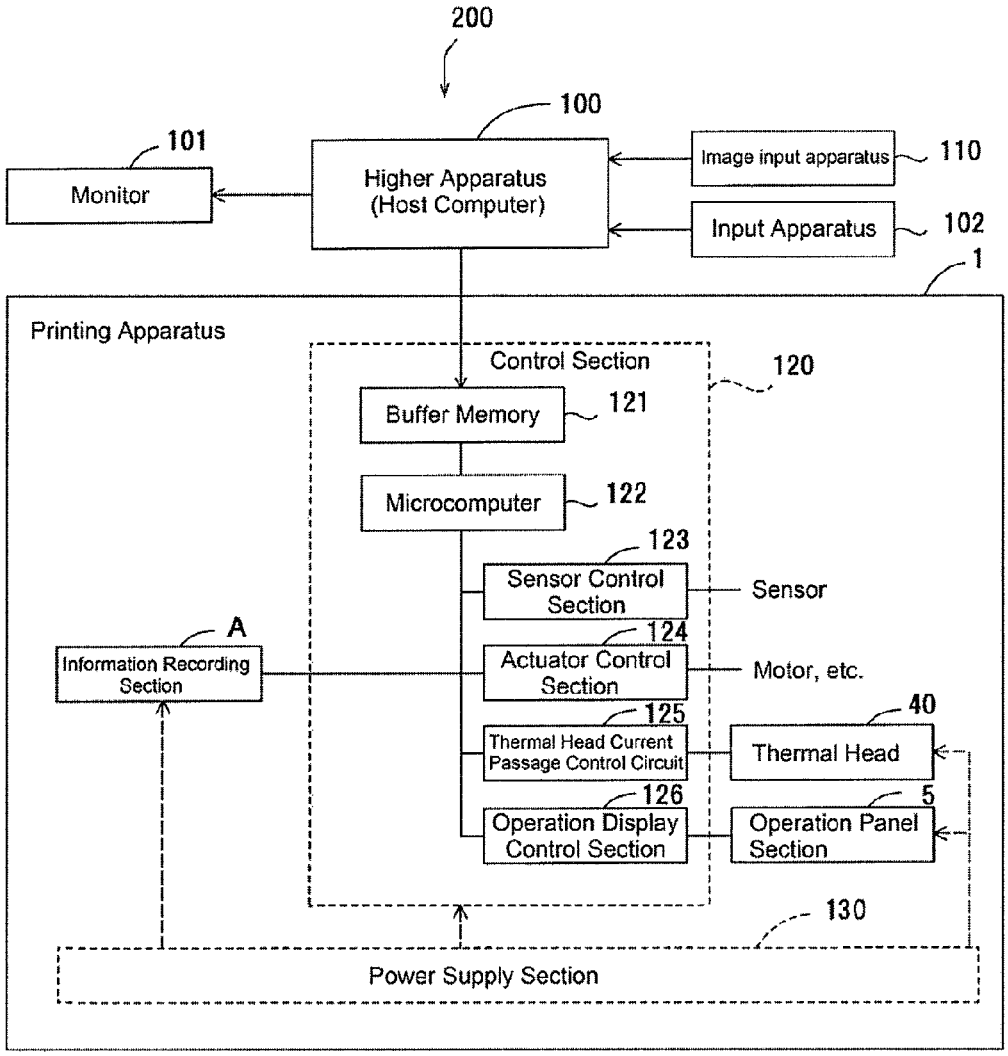
FIG. 12 is a block diagram illustrating a schematic configuration of a control section in the printing apparatus of Embodiment 1.

As shown in FIGS. 1 and 12, a printing apparatus 1 of this Embodiment constitutes a part of a printing system 200. In other words, the printing system 200 is broadly comprised of a higher apparatus 100 (for example, host computer such as a personal computer) and the printing apparatus 1.

The printing apparatus 1 is connected to the higher apparatus 100 via an interface with the figure omitted, and the higher apparatus 100 is capable of transmitting printing data, magnetic or electric recording data and the like to the printing apparatus 1 to indicate recording operation and the like. In addition, the printing apparatus 1 has an operation panel section (operation display section) 5 (see FIG. 12), and as well as recording operation indication from the higher apparatus 100, recording operation is also capable of being indicated from the operation panel section 5.

The higher apparatus 1 is generally connected to an image input apparatus 110 such as a digital camera and scanner, an input apparatus 102 such as a keyboard and mouse to input commands and data to the higher apparatus 100, and a monitor 101 such as a liquid crystal display to display data and the like generated in the higher apparatus 100.

<Printing Apparatus>

Figure 2:
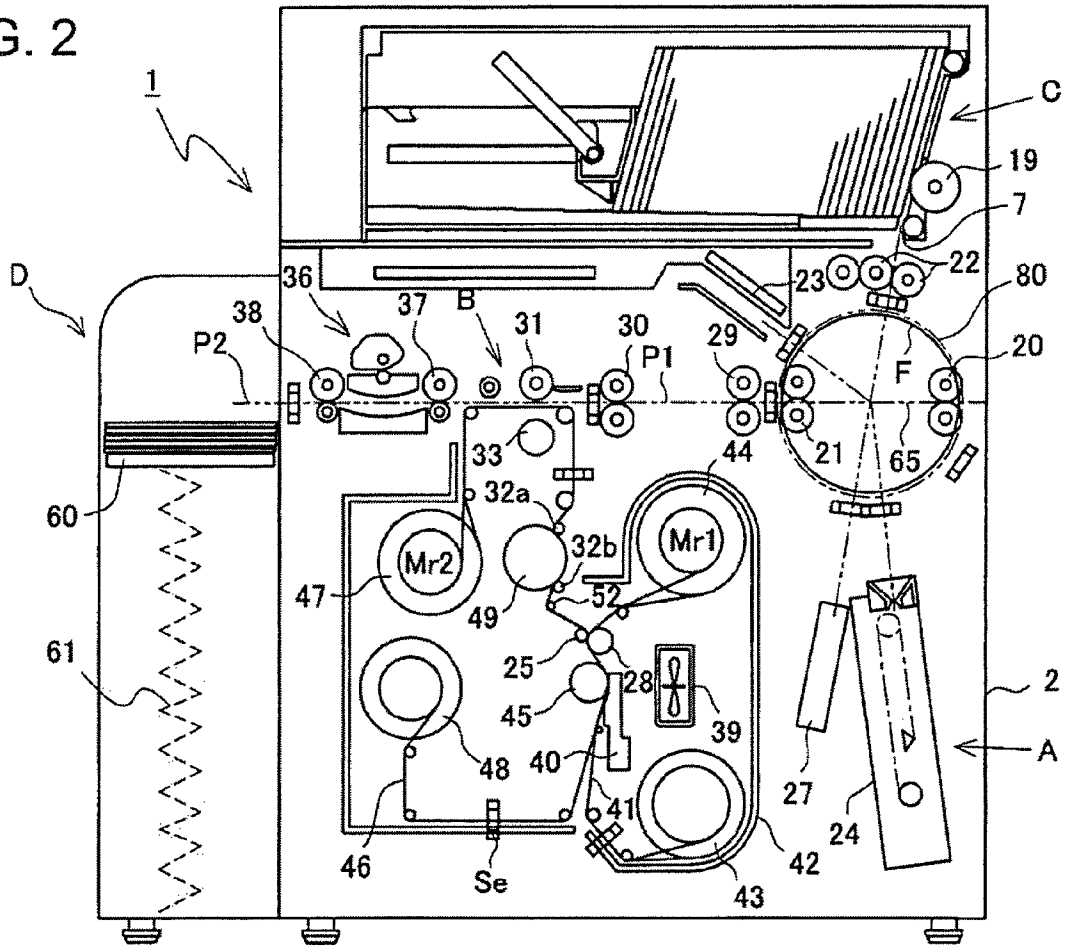
FIG. 2 is a configuration view of the printing apparatus of Embodiment 1.

As shown in FIG. 2, the printing apparatus 1 has a housing 2, and the housing 2 is provided with an information recording section A, image formation section B, media storage section C and storage section D.

The information recording section A is comprised of a magnetic recording section 24, non-contact type IC recording section 23, and contact type IC recording section 27.

The media storage section C aligns and stores a plurality of cards in a standing posture, is provided at its front end with a separation opening 7, and feeds and supplies starting with the card in the front row with a pickup roller 19.

The fed card is first sent to a reverse unit F with carry-in rollers 22. The reverse unit F is comprised of a rotating frame 80 bearing-supported by the housing 2 to be turnable, and two roller pairs 20, 21 supported on the frame. Then, the roller pairs 20, 21 are axially supported by the rotating frame 80 to be rotatable.

Around the reverse unit F in the turn direction are disposed the magnetic recording section 24, non-contact type IC recording section 23, and contact type IC recording section 27. Then, the roller pairs 20, 21 form a medium carry-in path 65 for carrying in toward one of the information recording sections 23, 24 and 27, and data is magnetically or electrically written on the card in the recording sections.

The image formation section B is to form an image such as a photograph of face and character data on frontside and backside of the card, and a medium transport path P1 for carrying the card is provided on an extension of the medium carry-in path 65. Further, in the medium transport path P1 are disposed transport rollers 29, 30 that transport the card, and the rollers are coupled to a transport motor not shown.

The image formation section B is provided with a film-shaped medium transport apparatus, a first transfer section that first prints an image, with a thermal head 40, on a transfer film 46 transported with the transport apparatus, and a second transfer section that subsequently prints the image printed on the transfer film 46 on the frontside of the card existing in the medium transport path P1 with a heat roller 33.

On the downstream side of the image formation section B is provided a medium transport path P2 for carrying the printed card to a storage stacker 60. In the medium transport path P2 are disposed transport rollers 37, 38 that transport the card, and the rollers are coupled to a transport motor not shown.

A decurl mechanism 36 is disposed in between the transport roller 37 and the transport roller 38, presses the card center portion held between the transport rollers 37, 38, and thereby corrects curl generated by thermal transfer with the heat roller 33. Therefore, the decurl mechanism 36 is configured to be able to shift to positions in the vertical direction as viewed in FIG. 2 by an up-and-down mechanism such as a cam not shown.

The storage section D is configured to store cards sent from the image formation section B in the storage stacker 60. The storage stacker 60 is configured to shift downward in FIG. 2 with an up-and-down mechanism 61.

The image formation section B in the entire configuration of the above-mentioned printing apparatus 1 will be further described specifically.

The transfer film 46 is wound around each of a wind-up roll 47 and feed roll 48 of a transfer film cassette rotated by driving a motor Mr2. A film transport roller 49 is a main driving roller for carrying the transfer film 46, and a transport amount and transport halt position of the transfer film 46 is determined by controlling driving of the roller 49. The motor Mr2 is also driven at the time of driving the film transport roller 49, is for the wind-up roll 47 to reel the fed transfer film 46, and is not driven as main transport of the transfer film 46.

Pinch rollers 32*a* and 32*b* are disposed on the periphery of the film transport roller 49. Although not shown in FIG. 2, the pinch rollers 32*a* and 32*b* are configured to be movable to move and retract with respect to the film transport roller 49, and in a state in the figure, the rollers move to the film transport roller 49 to come into press-contact, and thereby wind the transfer film 46 around the film transport roller 49. By this means, the transfer film 46 undergoes accurate transport by a distance corresponding to the number of revolutions of the film transport roller 49.

An ink ribbon 41 is stored in a cassette 42, the feed roll 43 and wind-up roll 44 are stored in the cassette 42, and the wind-up roll 44 is driven with a motor Mr1.

A platen roller 45 and thermal head 40 form the first transfer section, and the thermal head 40 is disposed in a position opposed to the platen roller 45. The thermal head 40 is heated and controlled by a head control IC (see FIG. 13) according to image data, and prints an image on the transfer film 46 using the sublimation ink ribbon 41. The thermal head 40 of this Embodiment has 1344 heater elements lined up in the main scanning direction, and will specifically be described later (see <Thermal head current passage control circuit>). In addition, a cooling fan 39 is to cool the thermal head 40.

The ink ribbon 41 with which printing on the transfer film 46 is finished is peeled off from the transfer film 46 with a peeling roller 25 and peeling member 28. The peeling member 28 is fixed to the cassette 42, the peeling roller 25 shifts to the peeling member 28 in printing, and the roller 25 and member 28 nip the transfer film 46 and ink ribbon 41 to peel. Then, the peeled ink ribbon 41 is wound around the wind-up roll 44 by driving the motor Mr1, and the transfer film 46 is transported to the second transfer section including a platen roller 31 and heat roller 33 by the film transport roller 49.

In the second transfer section, the transfer film 46 is nipped together with the card by the heat roller 33 and platen roller 31, and the image on the transfer film 46 is transferred to the card surface. In addition, the heat roller 33 is attached to an up-and-down mechanism (not shown) so as to come into contact with and separate from the platen roller 31 via the transfer film 46.

Figure 3:
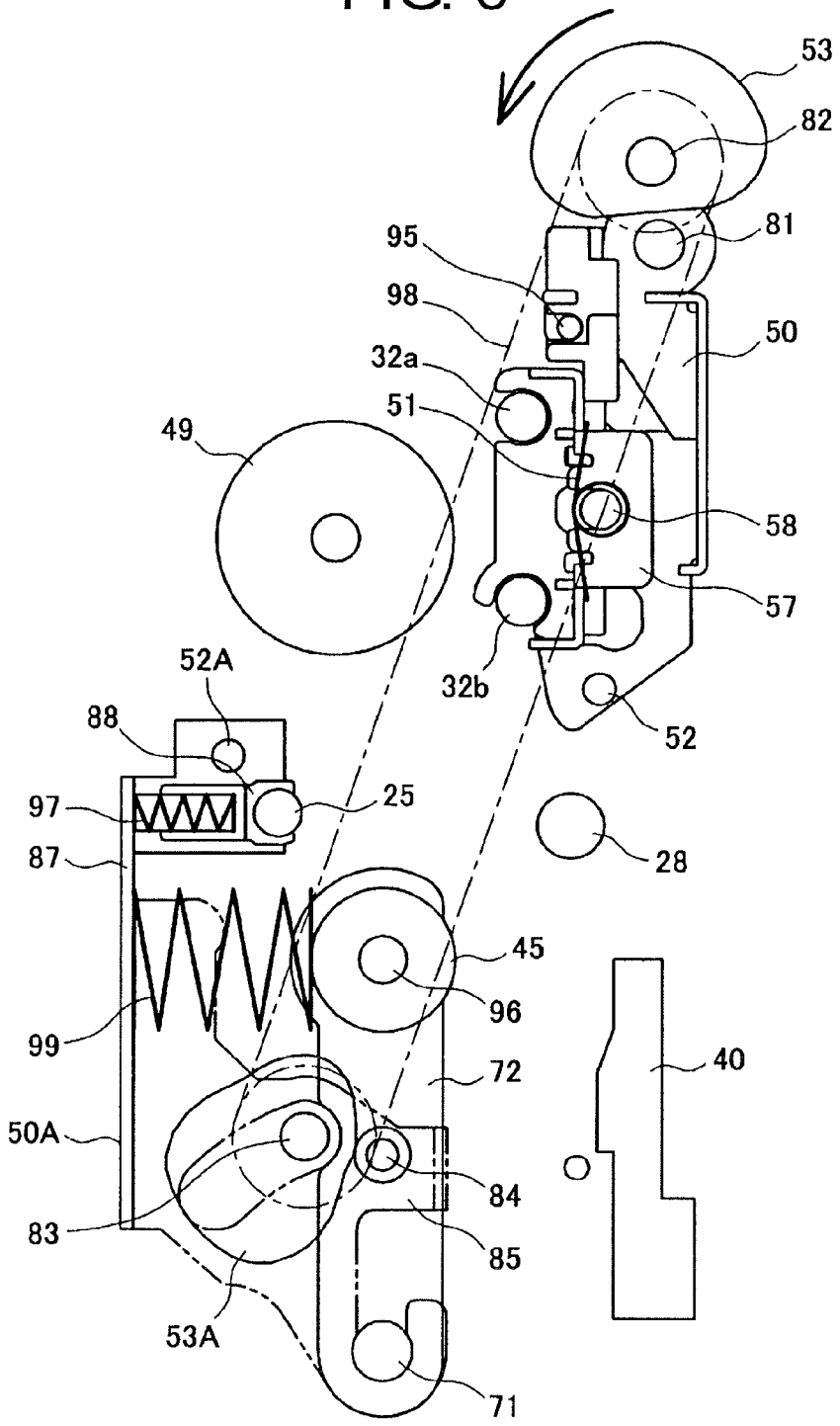
FIG. 3 is an explanatory view of a control state by a cam in a waiting position in which pinch rollers and film transport roller are separated from each other, and a platen roller and thermal head are separated from each other.
Figure 4:
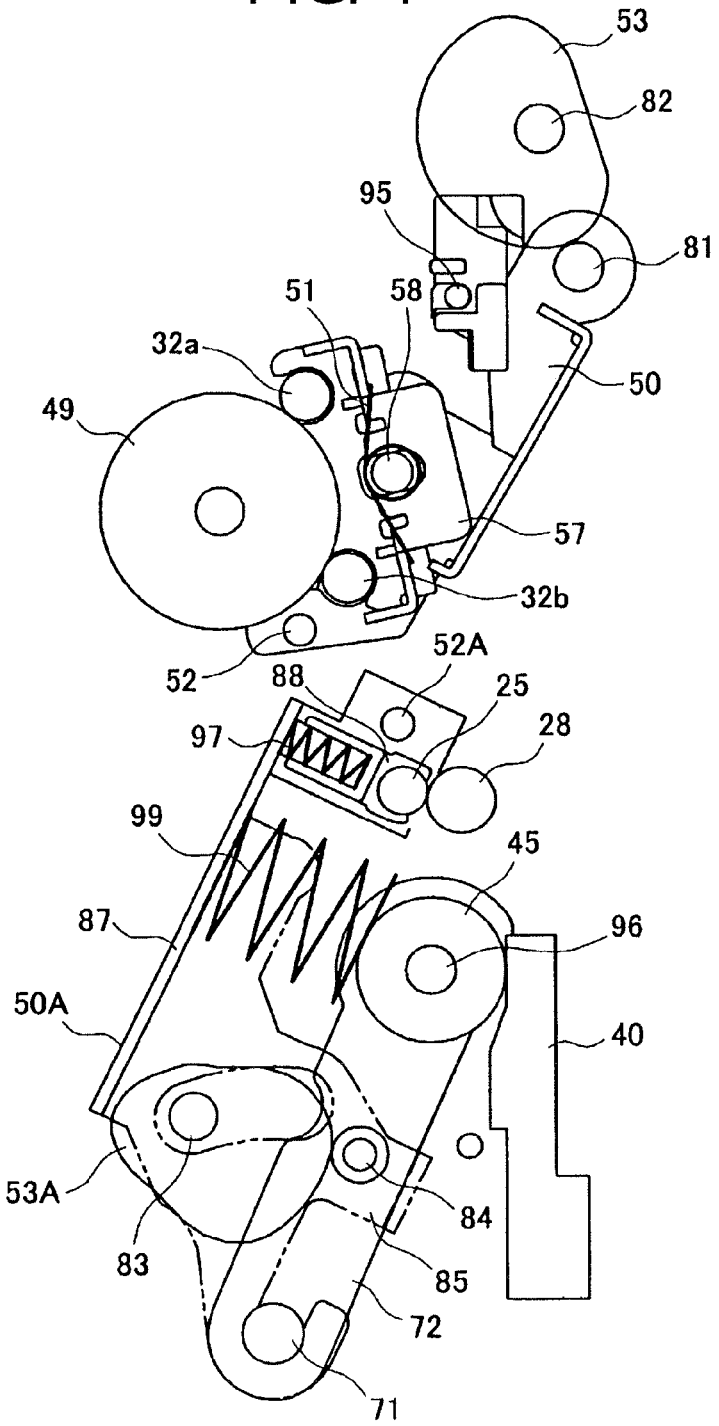
FIG. 4 is an explanatory view of a control state by the cam in a printing position in which the pinch rollers and film transport roller are brought into contact with each other, and the platen roller and thermal head are brought into contact with each other.
Figure 5:
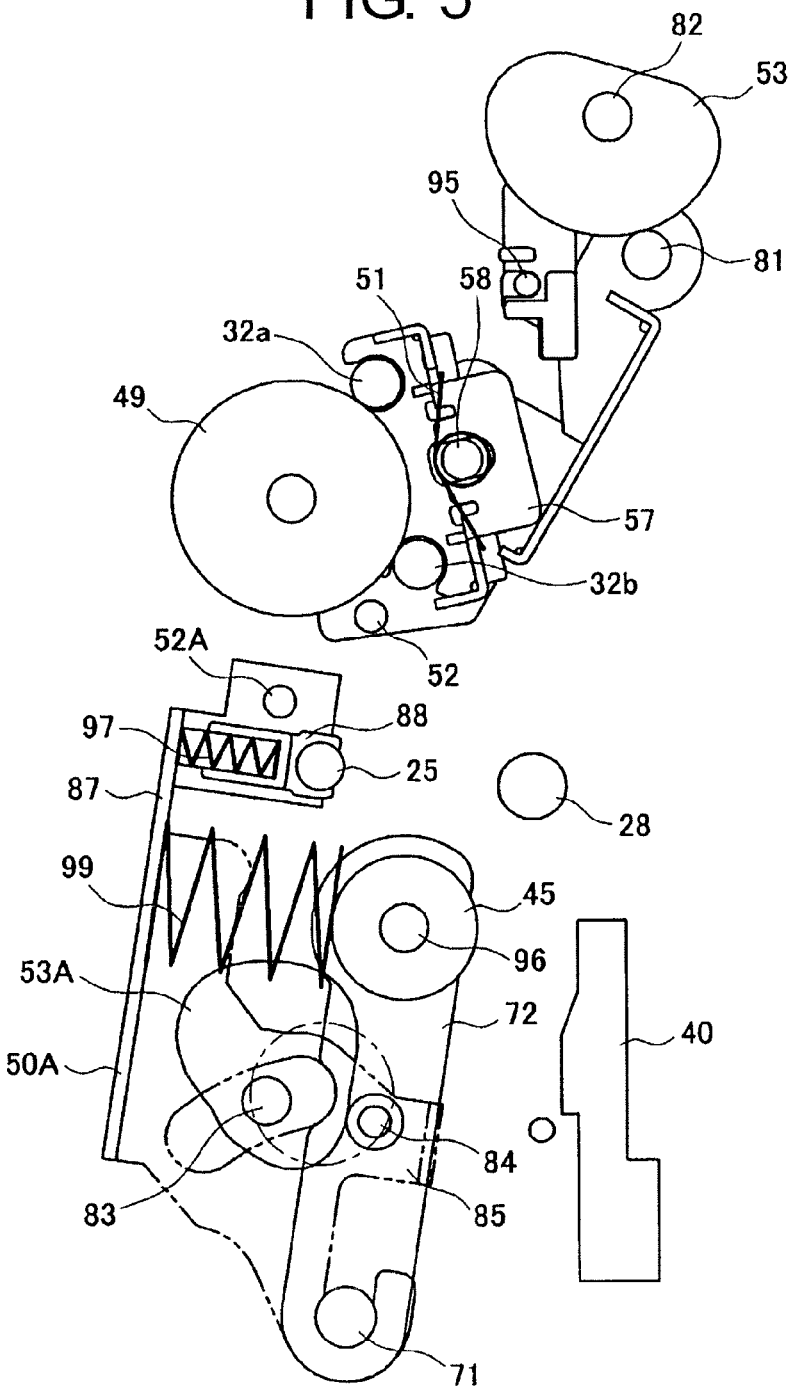
FIG. 5 is an explanatory view of a control state by the cam in a transport position in which the pinch rollers and film transport roller are brought into contact with each other, and the platen roller and thermal head are brought into contact with each other.
Figure 10:
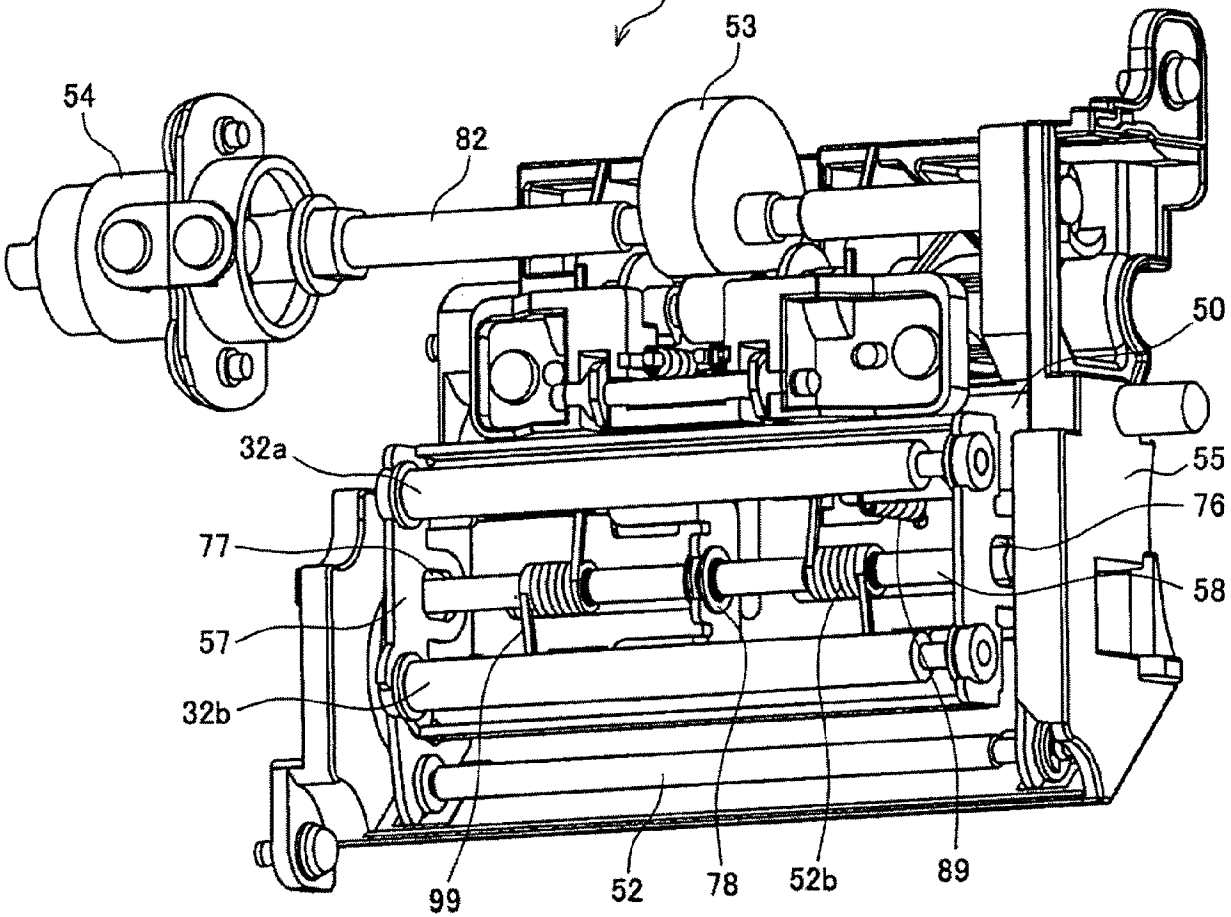
FIG. 10 is an outside view showing a configuration of a second unit integrated to incorporate the pinch rollers and their peripheral parts into the printing apparatus.

The configuration of the first transfer section will specifically be described further together with its action. As shown in FIGS. 3 to 5, the pinch rollers 32*a*, 32*b* are respectively supported by an upper end portion and lower end portion of a pinch roller support member 57, and the pinch roller support member 57 is supported rotatably by a support shaft 58 penetrating the center portion of the member 57. As shown in FIG. 10, the support shaft 58 is laid at its opposite end portions between long holes 76, 77 provided in the pinch roller support member 57, and is at its center portion fixed to a fix portion 78 of a bracket 50. Further, the long holes 76, 77 are provided with spaces in the horizontal direction and vertical direction with respect to the support shaft 58. Accordingly, it is made possible to adjust the pinch rollers 32*a*, 32*b* with respect to the film transport roller 49, described later.

Then, spring members 51 (51*a*, 51*b*) are mounted on the support shaft 58, and end portions on which the pinch rollers 32*a*, 32*b* are installed of the pinch roller support member 57 respectively contact the spring members 51, and are biased to the direction of the film transport roller 49 by the spring forces.

A bracket 50 comes into contact with the cam operation surface of a cam 53 in a cam receiver 81, and is configured to shift in the horizontal direction viewed in the figure with respect to the film transport roller 49, corresponding to rotation in the arrow direction of the cam 53 with a cam shaft 82 as the axis driven by a drive motor 54 (see FIG. 10). Accordingly, when the bracket 50 moves toward the film transport roller 49 (FIGS. 4 and 5), the pinch rollers 32*a*, 32*b* come into press-contact with the film transport roller 49 against the spring members 51 with the transfer film 46 nipped, and wind the transfer film 46 around the film transport roller 49.

At this point, the pinch roller 32*b* in a farther position from a shaft 95 as a rotation axis of the bracket 50 first comes into press-contact with the film transport roller 49, and next, the pinch roller 32*a* comes into press-contact. In this way, by arranging the shaft 95 that is the rotation axis higher than the film transport roller 49, the pinch roller support member 57 comes into contact with the film transport roller 49 while rotating, instead of parallel shift, and there is the advantage that the space in the width direction is less than in the parallel shift.

Further, the press-contact forces when the pinch rollers 32*a*, 32*b* come into press-contact with the film transport roller 49 are uniform in the width direction of the transfer film 46 by the spring members 51. At this point, since the long holes 76, 77 are provided on the opposite sides of the pinch roller support member 57 and the support shaft 58 is fixed to the fix portion 78, it is possible to adjust the pinch roller support member in three directions, and the transfer film 46 is transported in a correct posture by rotation of the film transport roller 49 without causing a skew. In other words, adjustments in three directions described herein are to (i) adjust the parallel degree in the horizontal direction of the shafts of the pinch rollers 32*a*, 32*b* with respect to the shaft of the film transport roller 49 to uniform the press-contact forces in the shaft direction of the pinch rollers 32*a*, 32*b* with respect to the film transport roller 49, (ii) adjust shift distances of the pinch rollers 32*a*, 32*b* with respect to the film transport roller 49 to uniform the press-contact force of the pinch roller 32*a* on the film transport roller 49 and the press-contact force of the pinch roller 32*b* on the film transport roller 49, and (iii) adjust the parallel degree in the vertical direction of the shafts of the pinch rollers 32*a*, 32*b* with respect to the shaft of the film transport roller 49 so that the shafts of the pinch rollers 32*a*, 32*b* are perpendicular to the film travel direction.

Then, the bracket 50 is provided with a tension receiving member 52 that comes into contact with a portion of the transfer film 46 which is not wound around the film transport roller 49 when the bracket 50 moves toward the film transport roller 49.

The tension receiving member 52 is provided to prevent the pinch rollers 32*a*, 32*b* from retracting from the film transport roller 49 respectively against the biasing forces of the spring members 51 due to the tension of the transfer film 46 occurring when the pinch rollers 32*a*, 32*b* bring the transfer film 46 into press-contact with the film transport roller 49. Accordingly, the tension receiving member 52 is attached to the front end of the end portion on the rotation side of the bracket 50 so as to come into contact with the transfer film 46 in the position to the left of the pinch rollers 32*a*, 32*b* viewed in the figure. FIG. 2 shows a state in which the tension receiving member 52 is brought into contact with the transfer film 46.

By this means, the cam 53 is capable of directly receiving the tension occurring due to elasticity of the transfer film 46 through the tension receiving member 52. Accordingly, the pinch rollers 32*a*, 32*b* are prevented from retracting from the film transport roller 49 due to the tension and from decreasing the press-contact forces of the pinch rollers 32*a*, 32*b*, thereby maintain the winding state in which the transfer film 46 is brought into intimate contact with the film transport roller 49, and are able to perform accurate transport.

Figure 9:
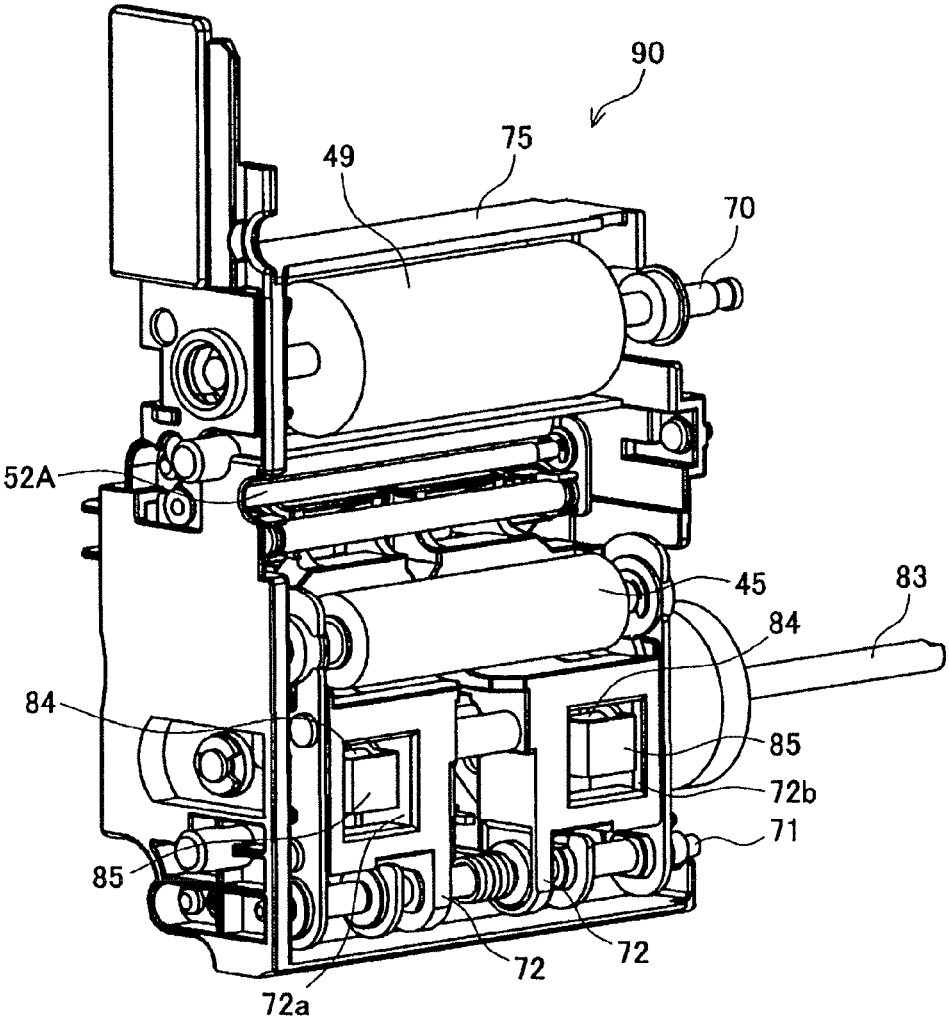
FIG. 9 is an outside view showing a configuration of a first unit integrated to incorporate the film transport roller, platen roller and their peripheral parts into the printing apparatus.

As shown in FIG. 9, the platen roller 45 disposed along the transverse width direction of the transfer film 46 is supported by a pair of platen support members 72 rotatable on a shaft 71 as the axis. The pair of platen support members 72 support opposite ends of the platen roller 45. The platen support members 72 are respectively connected to end portions of a bracket 50A having the shaft 71 as a common rotating shaft via spring members 99.

The bracket 50A is comprised of a substrate 87, and cam receiver support portion 85 formed by bending the substrate 87 in the direction of the platen support member 72, and the cam receiver support portion 85 holds a cam receiver 84. Then, a cam 53A rotating on a cam shaft 83 as the axis driven by the drive motor 54 is disposed between the substrate 87 and the cam receiver support portion 85, and is configured so that the cam operation surface and cam receiver 84 come into contact with each other. Accordingly, when the bracket 50A moves in the direction of the thermal head 40 by rotation of the cam 53A, the platen support members 72 also shift to bring the platen roller 45 into press-contact with the thermal head 40.

The spring members 99 and cam 53A are thus disposed vertically between the bracket 50A and platen support members 72, and it is thereby possible to store the platen shift unit within the distance between the bracket 50A and platen support members 72. Further, the width direction is held within the width of the platen roller 45, and it is possible to save space.

Moreover, since the cam receiver support portion 85 is fitted into bore portions 72*a*, 72*b* (see FIG. 9) formed in the platen support members 72, even when the cam receiver support portion 85 is formed while protruding in the direction of the platen support members 72, the distance between the bracket 50A and the platen support members 72 is not increased, and also in this respect, it is possible to save space.

When the platen roller 45 comes into press-contact with the thermal head 40, the spring members 99 connected to respective platen support members 72 act each so as to uniform the press-contact force on the width direction of the transfer film 46. Accordingly, when the transfer film 46 is transported by the film transport roller 49, the skew is prevented, and it is possible to perform thermal transfer by the thermal head 40 accurately without the printing region of the transfer film 46 shifting in the width direction.

The substrate 87 of the bracket 50A is provided with a pair of peeling roller support members 88 for supporting opposite ends of the peeling roller 25 via spring members 97, and when the bracket 50A moves to the thermal head 40 by rotation of the cam 53A, the peeling roller 25 comes into contact with the peeling member 28 to peel off the transfer film 46 and ink ribbon 41 nipped between the roller and member. The peeling roller support members 88 are also provided respectively at opposite ends of the peeling roller 25 as in the platen support members 72, and are configured so as to uniform the press-contact force in the width direction on the peeling member 28.

A tension receiving member 52A is provided in an end portion on the side opposite to the end portion on the shaft support 59 side of the bracket 50A. The tension receiving member 52A is provided to absorb the tension of the transfer film 46 occurring in bringing the platen roller 45 and peeling roller 25 respectively into press-contact with the thermal head 40 and peeling member 28. The spring members 99 and 97 are provided so as to uniform the press-contact force on the width direction of the transfer film 46, and in order for the spring members 99 and 97 not to be inversely behind the tension of the transfer film 46 and decrease the press-contact force on the transfer film 46, the tension receiving member 52A receives the tension from the transfer film 46. In addition, since the tension receiving member 52A is also fixed to the bracket 50A as in the above-mentioned tension receiving member 52, the cam 53A receives the tension of the transfer film 46 via the bracket 50A, and is not behind the tension of the transfer film 46. By this means, the press-contact force of the thermal head 40 and platen roller 45 and the press-contact force of the peeling member 28 and peeling roller 25 are held, and it is thereby possible to perform excellent printing and peeling. Further, any error does not occur in the transport amount of the transfer film 46 in driving the film transport roller 49, the transfer film 46 corresponding to the length of the printing region is accurately transported to the thermal head 40, and it is possible to perform printing with accuracy.

The cam 53 and cam 53A are driven by same drive motor 54 with a belt 98 (see FIG. 3) laid therebetween.

Figure 6:
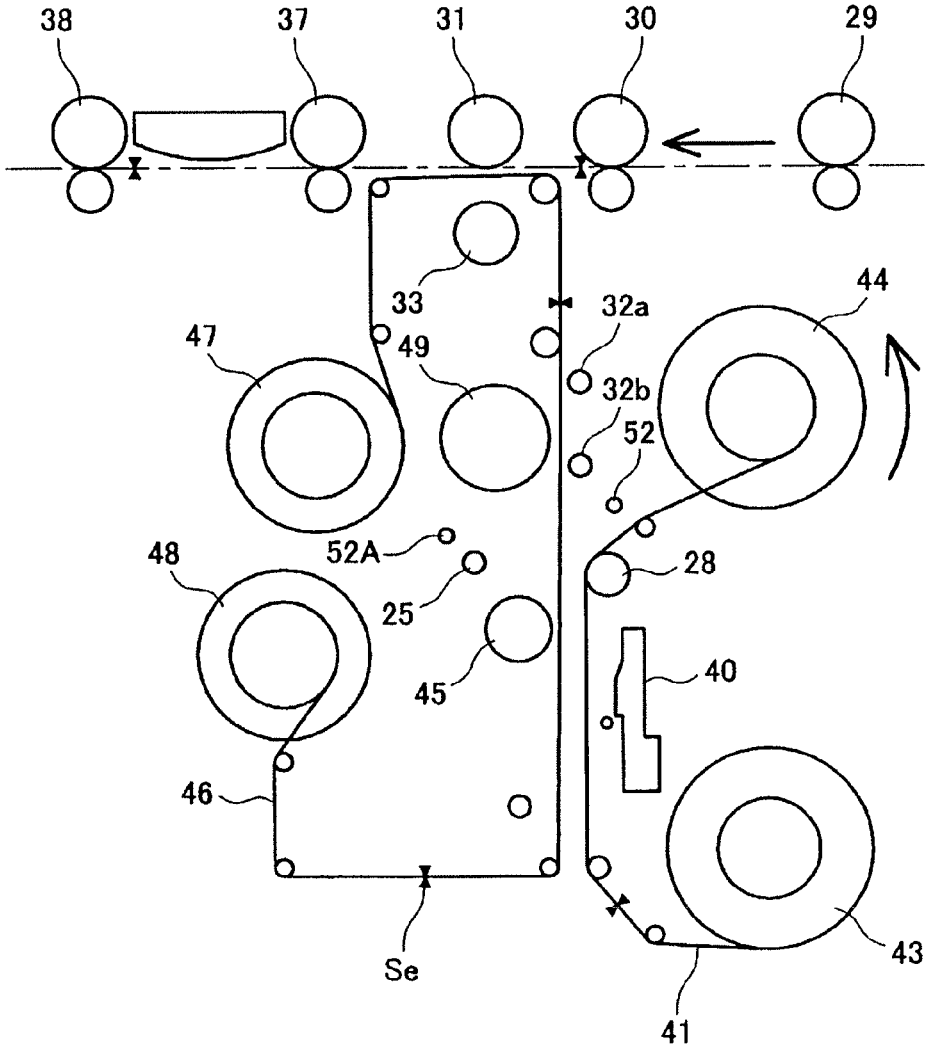
FIG. 6 is an operation explanatory view to explain the state of the waiting position in the printing apparatus.

When the image formation section B is in such awaiting position as shown in FIG. 6, the cam 53 and cam 53A are in the state as shown in FIG. 3, the pinch rollers 32*a*, 32*b* are not brought into press-contact with the film transport roller 49, and the platen roller 45 is not brought into press-contact with the thermal head 40 either.

Figure 7:
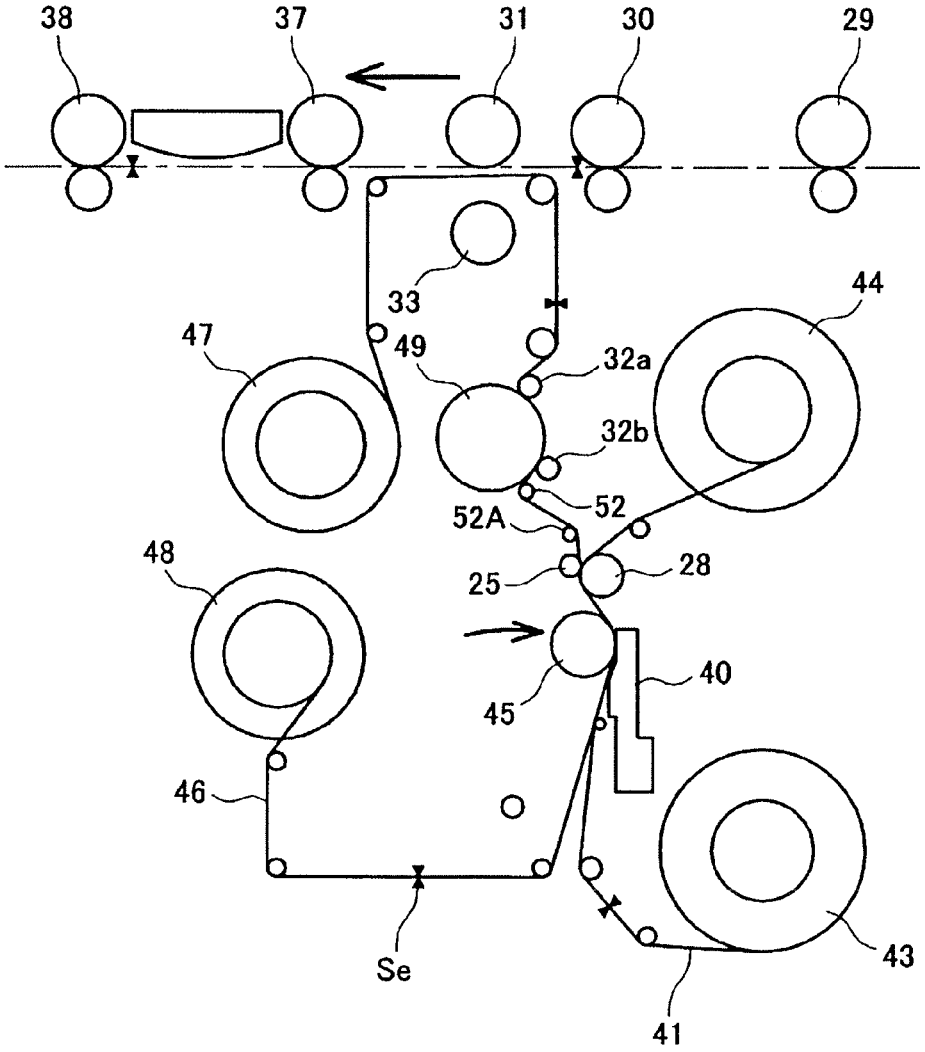
FIG. 7 is an operation explanatory view to explain the state of the transport position in the printing apparatus.

Then, when the cam 53 and cam 53A are rotated in conjunction with each other and are in the state as shown in FIG. 4, the image formation section B shifts to a printing position as shown in FIG. 7. At this point, the pinch rollers 32*a*, 32*b* first wind the transfer film 46 around the film transport roller 49, and concurrently, the tension receiving member 52 comes into contact with the transfer film 46. Subsequently, the platen roller 45 comes into press-contact with the thermal head 40. In this printing position, the plate roller 45 shifts toward the thermal head 40 to nip the transfer film 46 and ink ribbon 41 and come into press-contact, and the peeling roller 25 is in contact with the peeling member 28.

In this state, when transport of the transfer film 46 is started by rotation of the film transport roller 49, at the same time, the ink ribbon 41 is also wound around the wind-up roll 44 by operation of the motor Mr1 and transported in the same direction. During this transport, a positioning mark provided in the transfer film 46 passes through a sensor Se and shifts a predetermined amount, and at the time the transfer film 46 arrives at a printing start position, printing by the thermal head 40 is performed on the predetermined region of the transfer film 46. Particularly, since the tension of the transfer film 46 is large during printing, the tension of the transfer film 46 acts on the direction for separating the pinch rollers 32*a*, 32*b* from the film transport roller 49 and the direction for separating the peeling roller 25 and platen roller 45 from the peeling member 28 and thermal head 40. However, as described above, since the tension of the transfer film 46 is received in the tension receiving members 52, 52A, the press-contact forces of the pinch rollers 32*a*, 32*b* are not decreased, it is thereby possible to perform accurate film transport, the press-contact force of the thermal head 40 and platen roller 45 and the press-contract force of the peeling member 28 and peeling roller 25 are not decreased either, and it is possible to perform accurate printing and peeling. The ink ribbon 41 with which printing is finished is peeled off from the transfer film 46 and wound around the wind-up roll 44.

A shift amount by transport of the transfer film 46 i.e. a length in the transport direction of the printing region to undergo printing is detected by a sensor (not shown) provided in the film transport roller 49, rotation of the film transport roller 49 is halted corresponding to detection, and at the same time, winding by the wind-up roll 44 by operation of the motor Mr2 is also halted. By this means, finished is printing of the first color on the printing region of the transfer film 46 with the thermal head 40.

Figure 8:
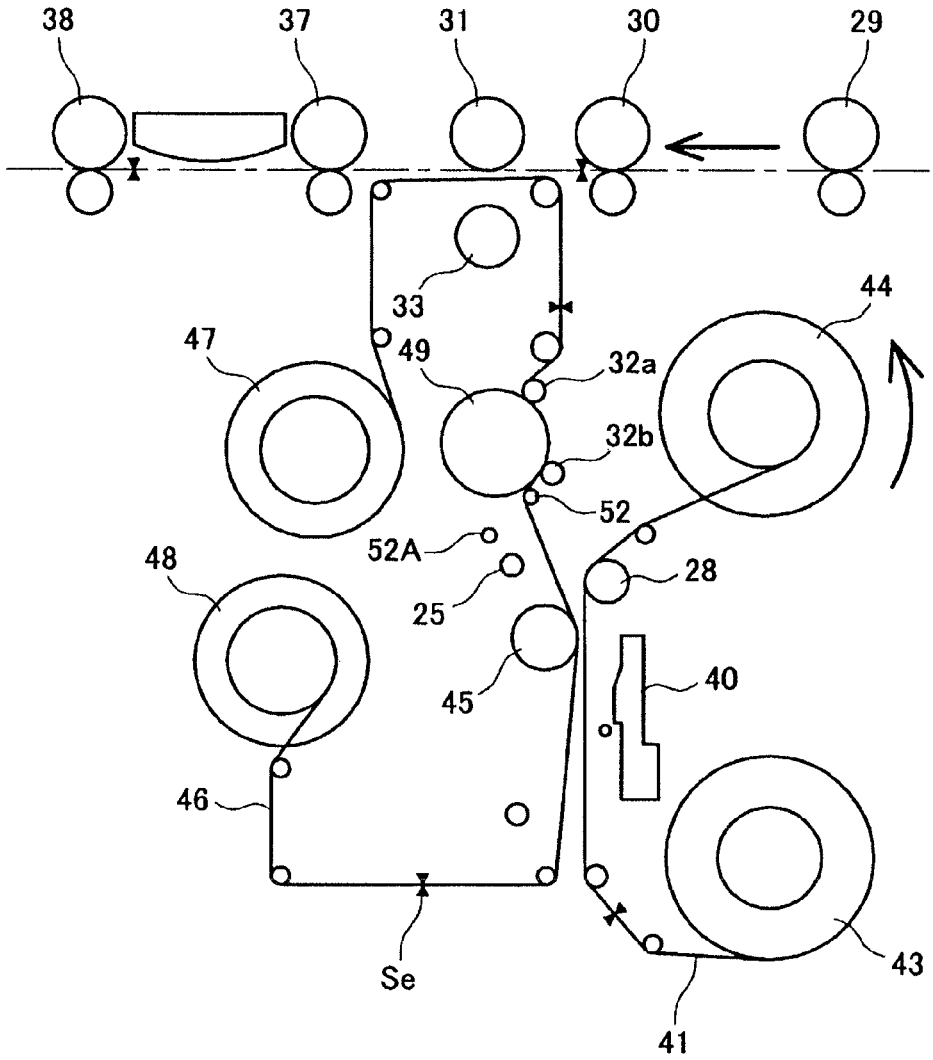
FIG. 8 is an operation explanatory view to explain the state of the printing position in the printing apparatus.

Then, when the cam 53 and cam 53A are further rotated in conjunction with each other and are in the state as shown in FIG. 5, the image formation section B shifts to a transport position as shown in FIG. 8, and the platen roller 45 returns to the direction of retracting from the thermal head 40. In this state, the pinch rollers 32*a*, 32*b* still wind the transfer film 46 around the film transport roller 49, the tension receiving member 52 is in contact with the transfer film 46, and the transfer film 46 is transported backward to an initial position by rotation in the backward direction of the film transport roller 49. Also at this point, the shift amount of the transfer film 46 is controlled by rotation of the film transport roller 49, and the transfer film 46 is transported backward corresponding to the length in the transport direction of the printing region subjected to printing. In addition, the ink ribbon 41 is halted, and is in a state in which the panel of the color to print next waits in the initial position.

Then, the control state by the cam 53 and cam 53A becomes the state as shown in FIG. 4 again and the printing position as shown in FIG. 7, the platen roller 45 is brought into press-contact with the thermal head 40, the film transport roller 49 rotates in the forward direction again to shift the transfer film 46 corresponding to the length of the printing region, and printing with the next color is performed with the thermal head 40.

Thus, the operation in the printing position and transport position is repeated until printing of all colors is finished. Then, when printing (first transfer) with the thermal head 40 is finished, the first-transferred region of the transfer film 46 is transported to the heat roller 33, and at this point, the cam 53 and cam 53A shift to the state as shown in FIG. 3, and release press-contact with the transfer film 46. In subsequent second transfer, transfer to the card is performed while transporting the transfer film by driving of the wind-up roll 47.

Such an image formation section B is divided into three units 90, 91, 92 and each is integrated.

In the first unit 90 as shown in FIG. 9, a unit frame body 75 is installed with a drive shaft 70 that rotates by driving of the motor 54 (see FIG. 10), and the driving shaft 70 is inserted in the film transport roller 49. Below the film transfer film 49 are disposed the bracket 50A and a pair of platen support members 72, and these members are supported rotatably by the shaft 71 laid between opposite side plates of the unit frame body 75.

In FIG. 9, a pair of cam receiver support portions 85 that are a part of the bracket 50A appear from the bore portions 72*a*, 72*b* formed in the platen support members 72. The cam receiver support portions 85 hold a pair of cam receivers 84 disposed at the back thereof. Then, at the back of the cam receivers 84 is disposed the cam 53A installed in the camshaft 83 inserted in the unit frame body 75. The camshaft 83 is laid between opposite side plates of the unit frame body 75.

Figure 11:
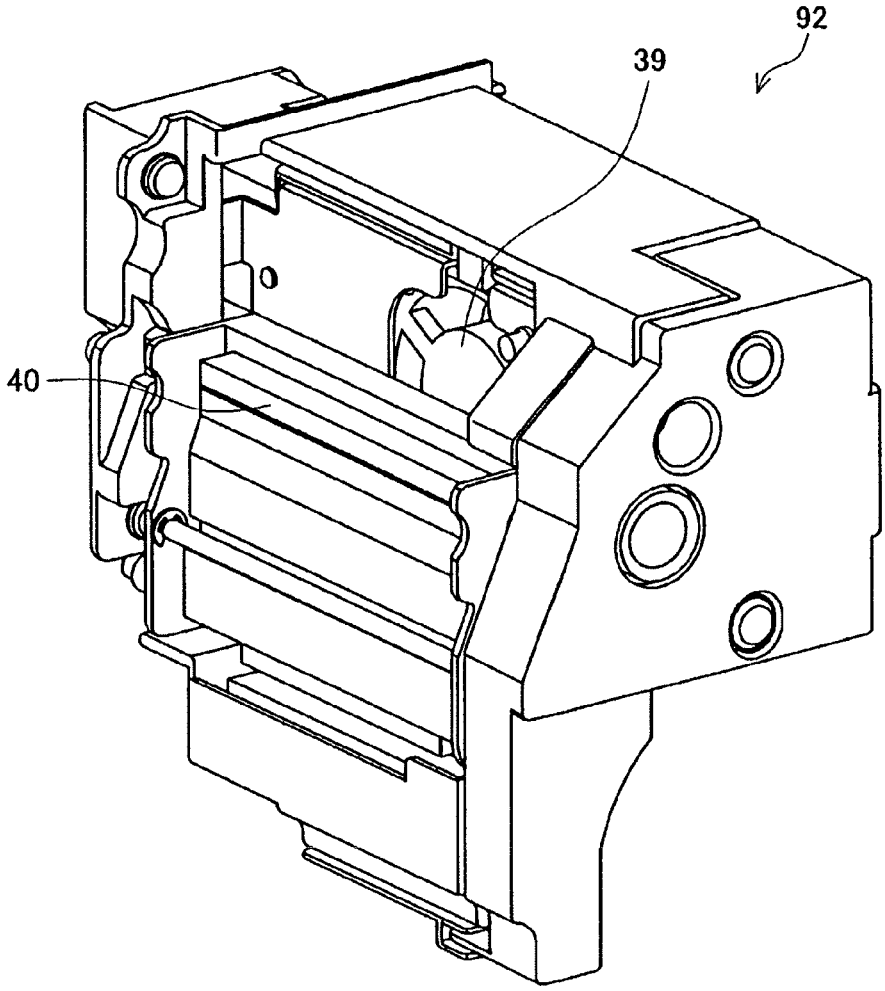
FIG. 11 is an outside view of a third unit integrated to incorporate the thermal head into the printing apparatus.

The thermal head 40 is disposed in the position opposed to the platen roller 45 with a transport path of the transfer film 46 and ink ribbon 41 therebetween. The thermal head 40, members related to heating and cooling fan 39 are integrated into the third unit 92 as shown in FIG. 11, and are disposed opposite the first unit 90.

The first unit 90 collectively holds the platen roller 45, peeling roller 25 and tension receiving member 52A varying in position by printing operation in the movable bracket 50A, and thereby eliminates the need of position adjustments among the members. Moreover, by shifting the bracket 50A by rotation of the cam 53, it is possible to shift the members to predetermined positions. Further, since the bracket 50A is provided, it is possible to store in the same unit as that of the fixed film transport roller 49, the transport drive portion by the film transport roller 46 required to transport the transfer film with accuracy and the transfer position regulation portion by the platen roller 45 are included in the same unit, and therefore, the need is eliminated for position adjustments between both portions.

In the second unit 91 as shown in FIG. 10, the cam shaft 82 installed with the cam 53 is inserted in a unit frame body 55, and is coupled to an output shaft of the drive motor 54. Then, the second unit 91 supports the bracket 50 in the unit frame body 55 movably to come into contact with the cam 53, and to the bracket 50 are fixed the support shaft 58 that supports the pinch roller support member 57 rotatably and the tension receiving member 52.

In the pinch roller support member 57, the spring members 51*a*, 51*b* are attached to the support shaft 58, and their end portions are respectively brought into contact with the opposite ends of the pinch roller support member 57 that supports the pinch rollers 32*a*, 32*b* to bias to the direction of the film transport roller 49. Then, in the pinch roller support member 57, the support shaft 58 is inserted in the long holes 76, 77, and is fixed and supported in the center portion by the bracket 50.

A spring 89 for biasing the pinch roller support member 57 toward the bracket 50 is provided between the bracket 50 and the pinch roller support member 57. By this spring 89, the pinch roller support member 57 is biased in the direction of moving backward from the film transport roller 49 of the first unit 90, and therefore, it is possible to easily pass the transfer film 46 through between the first unit 90 and the second unit 91 in setting the transfer film cassette in the printing apparatus 1.

The second unit 91 holds the pinch rollers 32*a*, 32*b*, and tension receiving member 52 varying in position corresponding to printing operation in the bracket 50A, shifts the pinch rollers 32*a*, 32*b*, and tension receiving member 52 by shifting the bracket 50A by rotation of the cam 53, and thereby simplifies position adjustments between the rollers and member, and position adjustments between the pinch rollers 32*a*, 32*b* and the film transport roller 49. Such a second unit 91 is disposed opposite the first unit 90 with the transfer film 46 therebetween.

By thus making the units, it is also possible to pull each of the first unit 90, second unit 92 and third unit 93 out of the main body of the printing apparatus 1 as in the cassette of each of the transfer film 46 and ink ribbon 41. Accordingly, in replacing the cassette due to consumption of the transfer film 46 or ink ribbon 41, when the units 90, 91 and 92 are pulled out as required, it is possible to install the transfer film 46 or ink ribbon 41 readily inside the apparatus in inserting the cassette.

As described above, by combining the first unit 90 into which are integrated the platen roller 45, bracket 50A, cam 53A, and platen support member 72, and the second unit 91 into which are integrated the pinch rollers 32*a*, 32*b*, bracket 50, cam 53 and spring members 51, and placing and installing the third unit 92 with the thermal head 40 attached thereto opposite the platen roller 45, it is possible to perform assembly in manufacturing the printing apparatus and adjustments in maintenance with ease and accuracy. Moreover, by integrating, it is possible to perform removal from the apparatus with ease, and the handleability as the printing apparatus is improved.

Described next is control and electric system of the printing apparatus 1. As shown in FIG. 12, the printing apparatus 1 has a control section 120 that performs operation control of the entire printing apparatus 1, and a power supply section 130 that transforms utility AC power supply into DC power supply that enables each mechanism section, control section and the like to be driven and actuated.

<Control Section of the Printing Apparatus>

As shown in FIG. 12, the control section 120 is provided with a microcomputer 122 that performs entire control processing of the printing apparatus 1. The microcomputer 122 is comprised of a CPU that operates at fast clock as the central processing unit, ROM in which is stored basic control operation (programs and program data) of the printing apparatus 1, RAM that works as a work area of the CPU, and internal buses that connect the components.

The microcomputer 122 is connected to an external bus. The external bus is connected to an interface, not shown, to communicate with the higher apparatus 100, and buffer memory 121 to temporarily store printing data to print on the card, recording data to magnetically or electrically record in a magnetic stripe portion or built-in IC of the card, and the like.

Further, the external bus is connected to a sensor control section 123 that controls signals from various sensors, an actuator control section 124 that controls motor drivers and the like for outputting drive pulses and drive power to respective motors, a thermal head current passage control circuit 125 to control thermal energy to heater elements constituting the thermal head 40, an operation display control section 126 to control the operation panel section 5, and the above-mentioned information recording section A. In addition, physically, the thermal head current passage control circuit 125 is disposed in the thermal head 40.

The power supply section 130 supplies operation/drive power to the control section 120, thermal head 40, operation panel section 5 and information recording section A.

<Thermal Head Current Passage Control Circuit>

The thermal head current passage control circuit 125 of the printing apparatus 1 of this Embodiment will be described next with reference to FIG. 13.

As described above, the thermal head 40 is comprised of 1344 heater elements lined up in the main scanning direction. The printing processing on one printing line with one heater element constitutes one pixel (one dot) of an image formed on the transfer film 46. FIG. 13 represents the heater elements by R as resistors. In this Embodiment, in response to IC1 to IC7, 1344 heater elements are divided into 7 blocks (first block to seventh block) every 192 elements.

Figure 13:
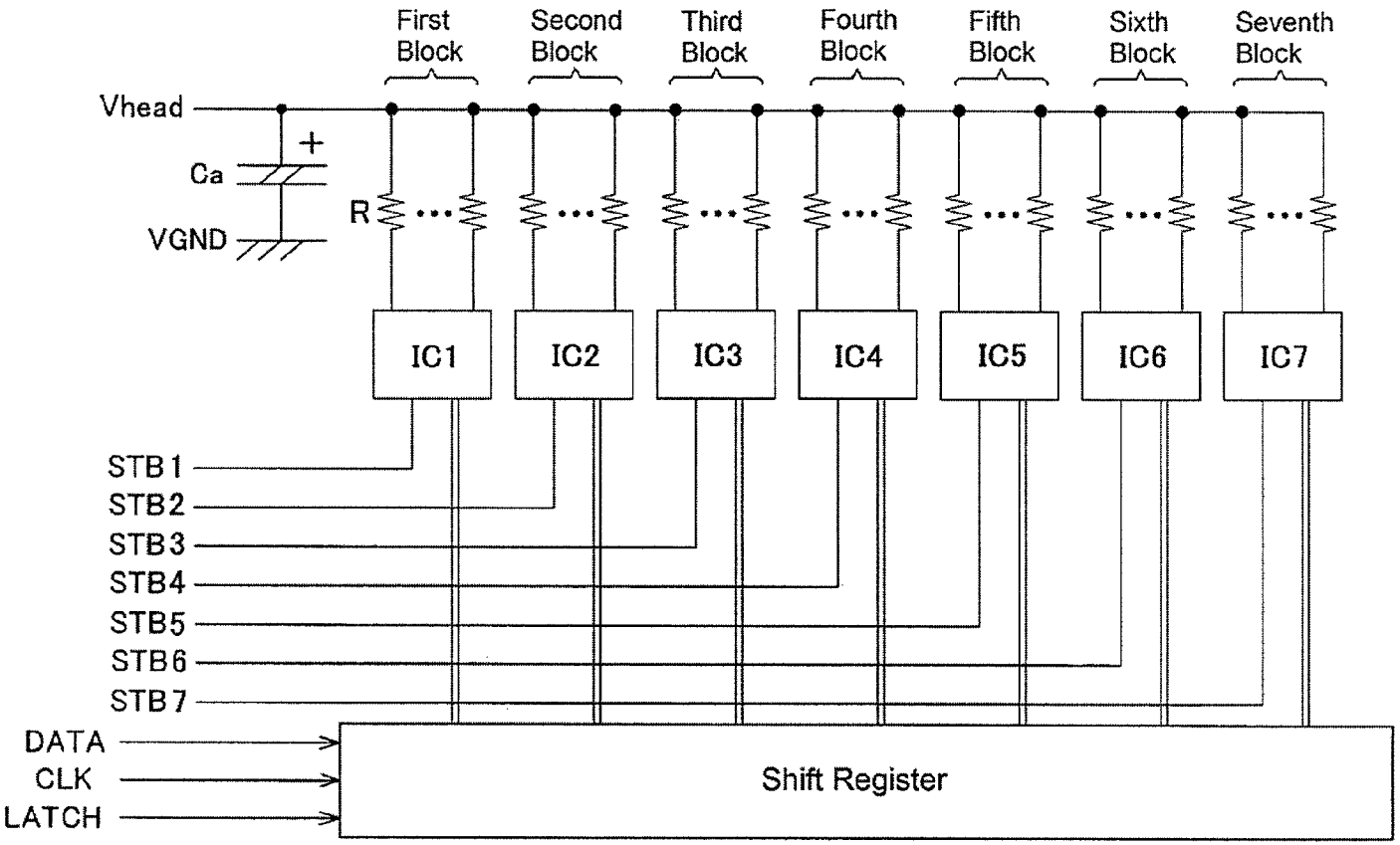
FIG. 13 is a block circuit diagram illustrating a thermal head current passage control circuit of Embodiment 1.

As shown in FIG. 13, one end of each heater element R is connected to thermal head applied voltage Vhead (power supply voltage), and the other end is connected to an IC corresponding to the block to which the heater element R belongs. For example, each IC has 192 AND circuits and NOT circuits and is comprised thereof. For example, the other end of each heater element R belonging to the first block is connected to the output side of the NOT circuit connected to the output side of the AND circuit (also see FIG. 14).

The input side of one of each AND circuit is connected to one of seven strobe signal input ports STB1 to STB7 to which strobe signals are input. For example, the input side of one of each AND circuit of IC1 is connected to the first strobe signal STB1 input port, and the input side of one of each AND circuit of IC2 is connected to the second strobe signal STB2 input port (also see FIG. 14). The other input side of each AND circuit is connected to a shift register SR. The other input side of each AND circuit and shift register are connected with a bus. In addition, at the same timing a first strobe signal described later is input to the first strobe signal STB1 input port, third strobe signal STB3 input port, fifth strobe signal STB5 input port, and seventh strobe signal STB7 input port, and at the same timing a second strobe signal described later is input to the second strobe signal STB2 input port, fourth strobe signal STB4 input port, and sixth strobe signal STB6 input port.

To the shift register SR are input a printing line data signal (DATA) from the microcomputer 122, clock signal (CLK) and latch signal (LATCH) to retrieve the printing line data signal. In addition, an electrolytic capacitor Ca to relax a voltage drop of the thermal head applied voltage Vhead caused by the passage of current through each heater element is inserted in between the thermal head applied voltage Vhead and thermal head ground voltage VGND. By such a configuration, the current is passed through only the heater element R such that the printing line data signal is input and that the STB is turned ON.

<First and Second Strobe Signals>

Described next are the first strobe signal and second strobe signal input to respective strobe signal input ports. In addition, described together is the thermal head applied voltage Vhead (power supply voltage) and supply energy (integrated value of passage of current) to heater elements with the first strobe signal and second strobe signal.

Figure 15:
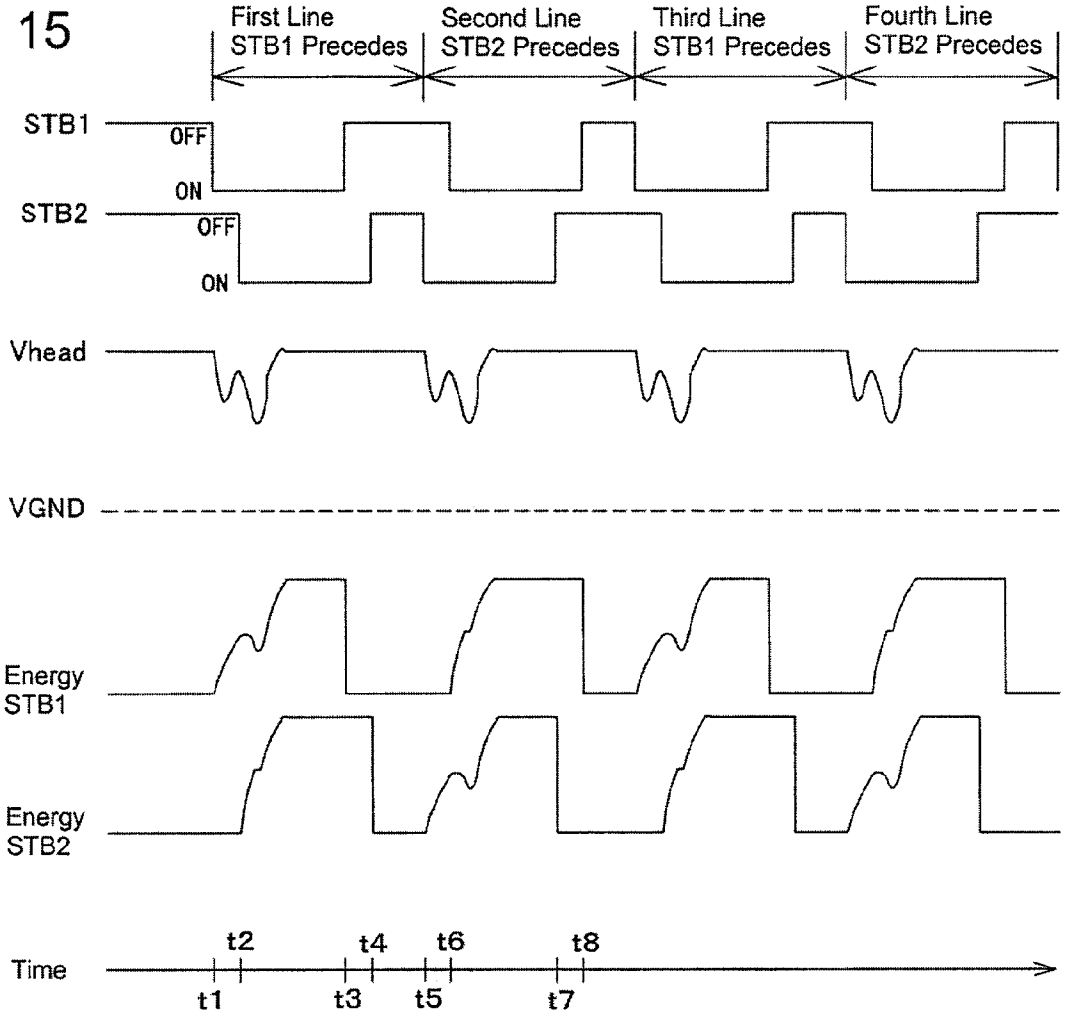
FIG. 15 is a timing chart of Embodiment 1 showing the relationship among a first strobe signal, second strobe signal, thermal head applied voltage, thermal head ground voltage, supply energy to heater elements with the first strobe signal, and supply energy to heater elements with the second strobe signal.

As shown in FIG. 15, on printing processing of a first printing line, the first strobe signal STB1 is switched to an ON state at time t1, and the second strobe signal STB2 is switched to an ON state at time t2. Subsequently, the first strobe signal STB1 is switched to an OFF state at time t3, and the second strobe signal STB2 is switched to the OFF state at time t4. Next, on printing processing of a second printing line, the second strobe signal STB2 is switched to the ON state at time t5, and the first strobe signal STB1 is switched to the ON state at time t6. Subsequently, the second strobe signal STB2 is switched to an OFF state at time t7, and the first strobe signal STB1 is switched to the OFF state at time t8. The first strobe signal STB1 and second strobe signal STB2 are controlled in ON/OFF in the same manner as in the printing processing of the first printing line in printing processing of the third and subsequent odd-numbered printing lines, and in the same manner as in the printing processing of the second printing line in printing processing of even-numbered printing lines after the third printing line.

By switching the first strobe signal STB1 to the ON state at time t1, a voltage drop occurs in the thermal head applied voltage Vhead, and the second strobe signal STB2 is switched to the ON state at time t2 before the thermal head applied voltage Vhead recovers to the original voltage. Further, by switching the second strobe signal STB2 to the ON state at time t5, a voltage drop occurs in the thermal head applied voltage Vhead, and the first strobe signal STB1 is switched to the ON state at time t6 before the thermal head applied voltage Vhead recovers to the original voltage. As a result, a difference occurs between supply energy (integrated value of passage of current) to heater elements with the first strobe signal STB1 and supply energy (integrated value of passage of current) to heater elements with the second strobe signal STB2. However, since the strobe signal which is first switched to the ON state is different between the first strobe signal STB1 and the second strobe signal STB2 for each printing line (for example, in the first printing line, the first strobe signal STB1 is first switched to the ON state, and in the second printing line, the second strobe signal STB2 is first switched to the ON state), for example, supply energy (integrated value of passage of current) to heater elements with the first strobe signal STB1 in the printing processing of the first printing line and the printing processing of the second printing line is the same as supply energy (integrated value of passage of current) to heater elements with the second strobe signal STB2 in the printing processing of the first printing line and the printing processing of the second printing line.

Accordingly, the first strobe signal STB1 and second strobe signal STB2 shown in FIG. 15 meet the following three current passage conditions:

(1) The current passage time periods for switching passage of current through heater elements belonging to odd-numbered blocks (first, third, fifth and seventh blocks) and even-numbered blocks (second, fourth and sixth blocks) as shown in FIG. 13 to the ON state partially overlap (for example, time t2 to time t3, time t6 to time t7);

(2) The current passage start timing (time t1, t2, t5, t6) for switching passage of current through heater elements belonging to the odd-numbered blocks and to heater elements belonging to the even-numbered blocks as shown in FIG. 13 to the ON state is temporally different completely from the current passage stop timing (time t3, t4, t7, t8) for switching passage of current through heater elements belonging to the odd-numbered blocks and to heater elements belonging to the even-numbered blocks as shown in FIG. 13 to the OFF state; and (3) In the case of printing data of the same concentration over a plurality of lines with heater elements belonging to the odd-numbered blocks and even-numbered blocks as shown in FIG. 13, a sum of an integrated value of current passed through heater elements belonging to the odd-numbered blocks as shown in FIG. 13 in printing processing of an odd-numbered printing line (for example, first printing line) and an integrated value of current passed through the heater elements belonging to the odd-numbered blocks as shown in FIG. 13 in printing processing of an even-numbered printing line (for example, second printing line) is the same as a sum of an integrated value of current passed through heater elements belonging to the even-numbered blocks as shown FIG. 13 in printing processing of the odd-numbered printing line (for example, first printing line) and an integrated value of current passed through the heater elements to the even-numbered blocks as shown in FIG. 13 in printing processing of the even-numbered printing line (for example, second printing line).

(Operation)

The printing processing operation on the transfer film 46 of the printing apparatus 1 of this Embodiment will be described next mainly on the CPU (hereinafter, simply referred to as CPU) of the microcomputer 120. In addition, since the entire operation of the printing apparatus 1 has already been described, to avid redundancy, described herein is the printing processing of a single color with the thermal head 40, generation of the strobe signal, and further, to deepen understanding, the relationship with the time of the timing chart as shown in FIG. 15.

Figure 16:
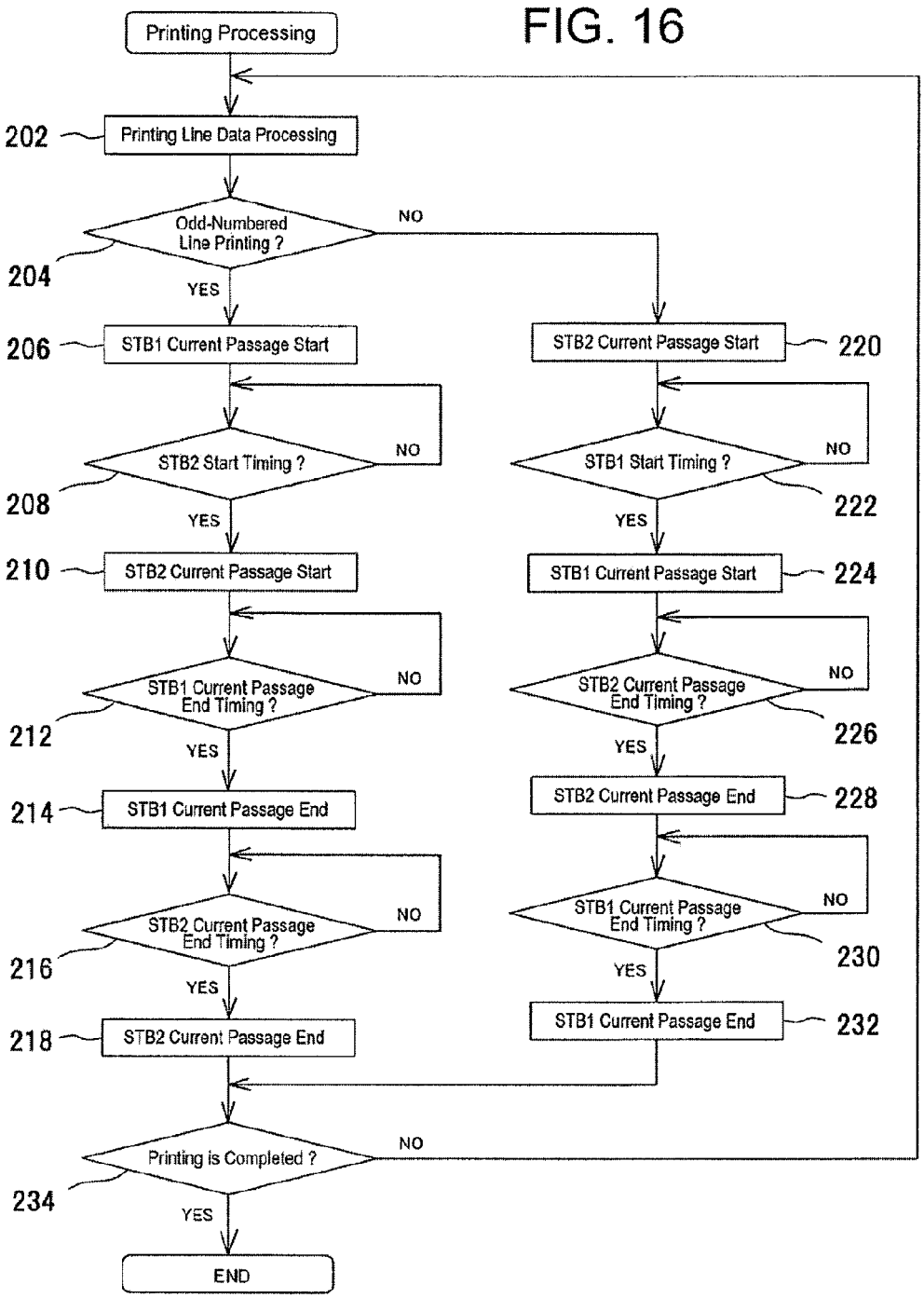
FIG. 16 is a flowchart of a printing processing routine executed by a CPU of the control section in the printing apparatus of Embodiment 1.

As shown in FIG. 16, the CPU executes printing line data processing in step 202. In the printing line data processing, based on printing data transmitted from the higher apparatus 100, the CPU identifies dots matched with heating conditions to generate each printing line data, and outputs first printing line data to the shift register SR of the thermal head 40. In addition, the image data is decomposed into color components (original data is R, G, B) on the higher apparatus 100 side, the printing apparatus 1 transforms R, G, B into Y, M, C to use as the printing data, and Bk data set on the higher apparatus 100 side is also used as the same printing data of Bk in the printing apparatus 1.

In next step 204, the CPU determines whether or not the printing is of an odd-numbered printing line, and in the case of a positive determination, switches the first strobe signal STB1 to an ON state (for example, time t1 in FIG. 15) in next step 206. Next, in step 208, the CPU determines whether or not timing is current passage start timing (for example, time t2 in FIG. 15) for switching the second strobe signal STB2 to an ON state, and waits in a negative determination, while in a positive determination, switching the second strobe signal STB2 to the ON state in next step 210.

Next, in step 212, the CPU determines whether or not timing is current passage end timing (for example, time t3 in FIG. 15) for switching the first strobe signal STB1 to an OFF state, and waits in a negative determination, while in a positive determination, switching the first strobe signal STB1 to the OFF state in next step 214. In next step 216, the CPU determines whether or not timing is current passage end timing (for example, time t4 in FIG. 15) for switching the second strobe signal STB2 to an OFF state, and waits in a negative determination, while in a positive determination, switching the second strobe signal STB2 to the OFF state in next step 218 to proceed to step 234.

Meanwhile, in the case where the determination in step 204 is negative, for printing of an even-numbered printing line, the second strobe signal STB2 is switched to the ON state (for example, time t5 in FIG. 15) in step 220. Next, in step 222, the CPU determines whether or not timing is current passage start timing (for example, time t6 in FIG. 15) for switching the first strobe signal STB1 to the ON state, and waits in a negative determination, while in a positive determination, switching the first strobe signal STB1 to the ON state in next step 224.

Next, in step 226, the CPU determines whether or not timing is current passage end timing (for example, time t7 in FIG. 15) for switching the second strobe signal STB2 to the OFF state, and waits in a negative determination, while in a positive determination, switching the second strobe signal STB2 to the OFF state in next step 228. In next step 230, the CPU determines whether or not timing is current passage end timing (for example, time t8 in FIG. 15) for switching the first strobe signal STB1 to the OFF state, and waits in a negative determination, while in a positive determination, switching the first strobe signal STB1 to the OFF state in next step 232 to proceed to step 234.

In step 234, the CPU determines whether or not printing is completed, and in a negative determination, returns to step 202 to output next printing line data to the shift register SR of the thermal head 40, while in a positive determination, finishing the printing processing.

Figure 14:
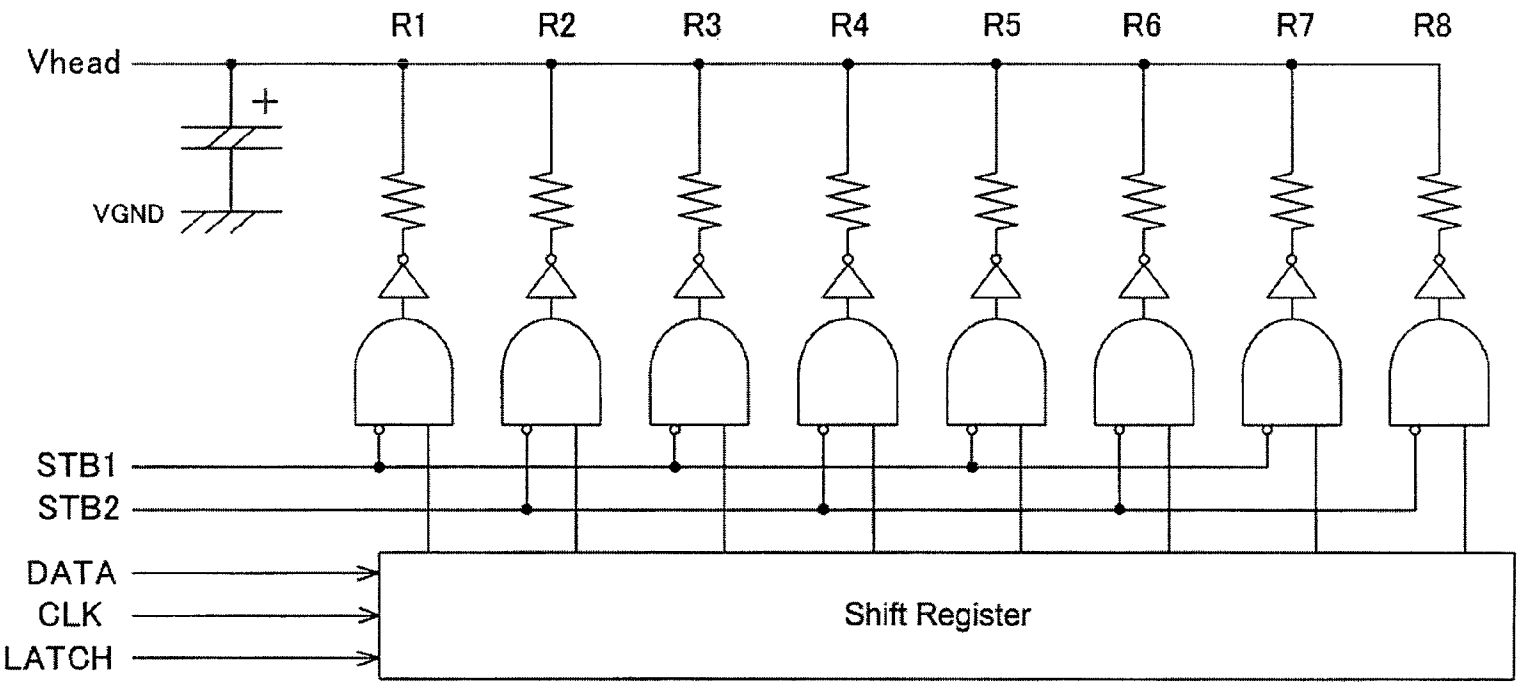
FIG. 14 is a block circuit diagram obtained by schematically simplifying the thermal head current passage control circuit of Embodiment 1.

In addition, in FIG. 14, a part of the block circuit diagram as shown in FIG. 13 is schematically simplified. In the block circuit diagram of FIG. 14, heater elements R of each of the first to seventh blocks are comprised of only one resistor, each of IC1 to IC7 is comprised of only one AND circuit and NOT circuit, an heater element R8 is added, and in the respects, the block circuit diagram of FIG. 14 differs from the block circuit diagram as shown in FIG. 13. In the block circuit diagram as shown in FIG. 13, among the first to seventh strobe signal input ports, the first strobe signal STB1 is input to odd-numbered strobe signal (STB1, STB3, STB5, STB7) input ports, the second strobe signal STB2 is input to even-numbered strobe signal (STB2, STB4, STB6) input ports, and therefore, the diagram is simplified with only two ports of first strobe signal STB1 input port and second strobe signal STB2 input port.

Figure 20A:
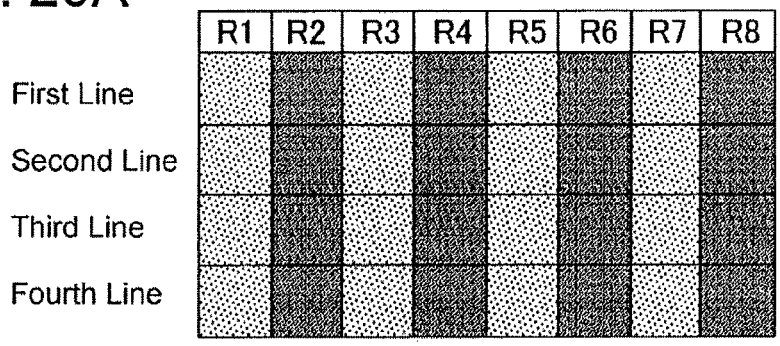
FIGS. 20A to 20C schematically show printing states of first to fourth printing lines with eight heater elements among heater elements lined up in the main scanning direction, where FIG. 20A corresponds to current passage control as shown in FIG. 22, FIG. 20B corresponds to current passage control as shown in FIG. 15, and FIG. 20C corresponds to current passage control as shown in FIG. 18.
Figure 20B:
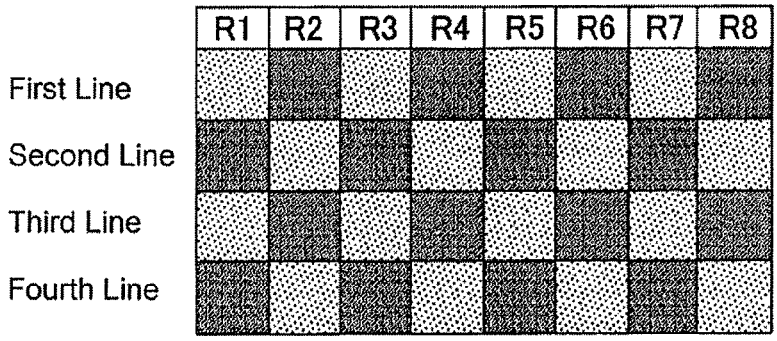
Figure 22:
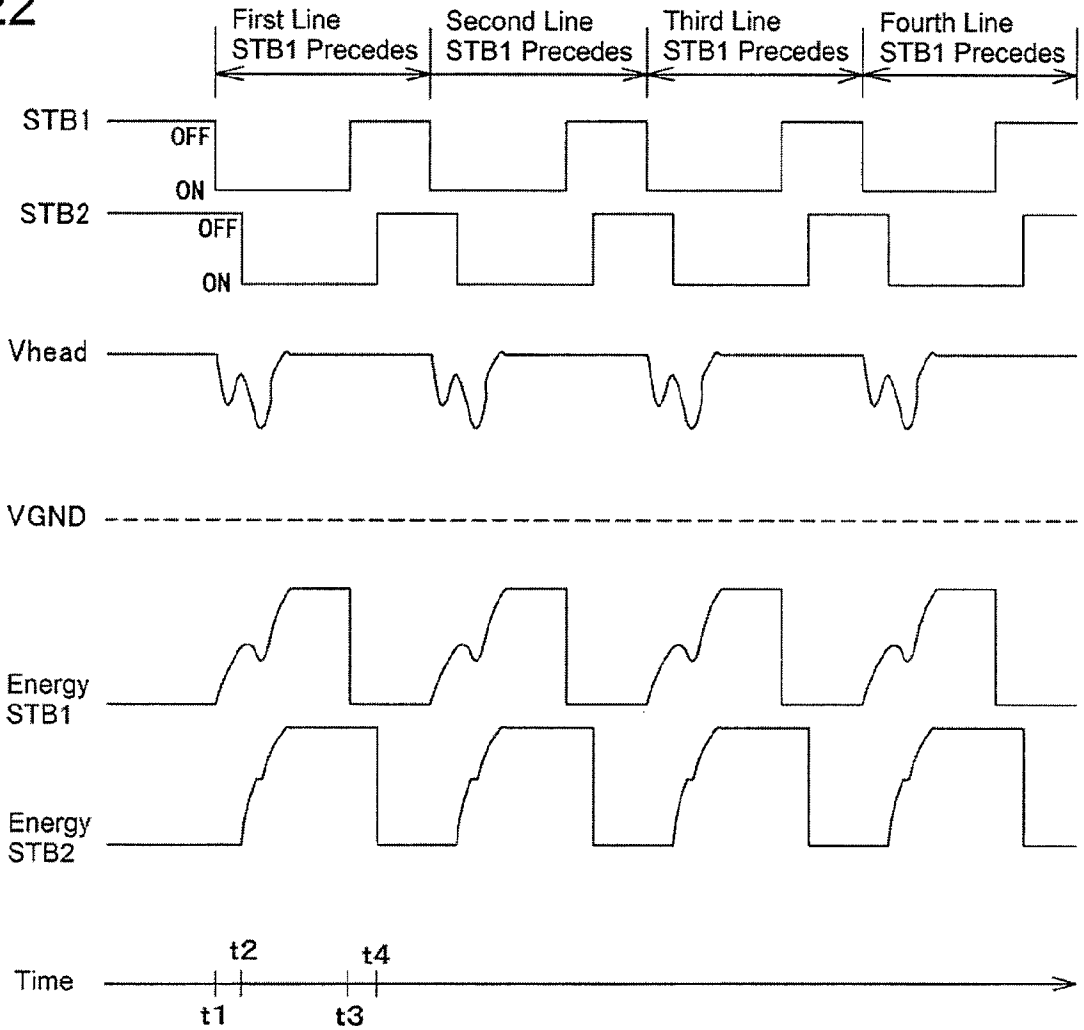
FIG. 22 is a timing chart showing the relationship among a first strobe signal, second strobe signal, thermal head applied voltage, thermal head ground voltage, supply energy to heater elements with the first strobe signal, and supply energy to heater elements with the second strobe signal.

FIG. 20B schematically shows a printing state of first to fourth printing lines with heater elements R 1 to R 8 in the case of performing current passage control as shown in FIG. 15 with the block circuit diagram of FIG. 14. Although the unevenness of concentration occurs in the pixel (dot) level, since light and dark is mixed evenly, it seems there is no unevenness of concentration when viewed with the human eye. In addition, FIG. 20A described above schematically shows a printing state in the case of performing current passage control as shown in FIG. 22 with the block circuit diagram of FIG. 14.

According to the printing apparatus 1 of this Embodiment, by the above-mentioned current passage condition (1), it is possible to make the printing speed higher, and by the above-mentioned current passage condition (3), it is possible to reduce the occurrence of the unevenness of concentration caused by a voltage drop of the thermal head applied voltage Vhead in passing currents through heater elements.

(Embodiment 2)

Described next is Embodiment 2 in which the present invention is applied to a printing apparatus. Embodiment 2 is an aspect in which the first strobe signal STB1 and the second strobe signal STB2 have a plurality of current passage pulses for switching passage of current through heater elements belonging to the odd-numbered blocks and heater elements belonging to the even-numbered blocks as shown in FIG. 13 to the ON state for the printing processing of one printing line. In addition, in Embodiment 2 and subsequent Embodiment, descriptions of the same configuration and the like as in above-mentioned Embodiment 1 are omitted, and only different points will be described below.

Figure 17:
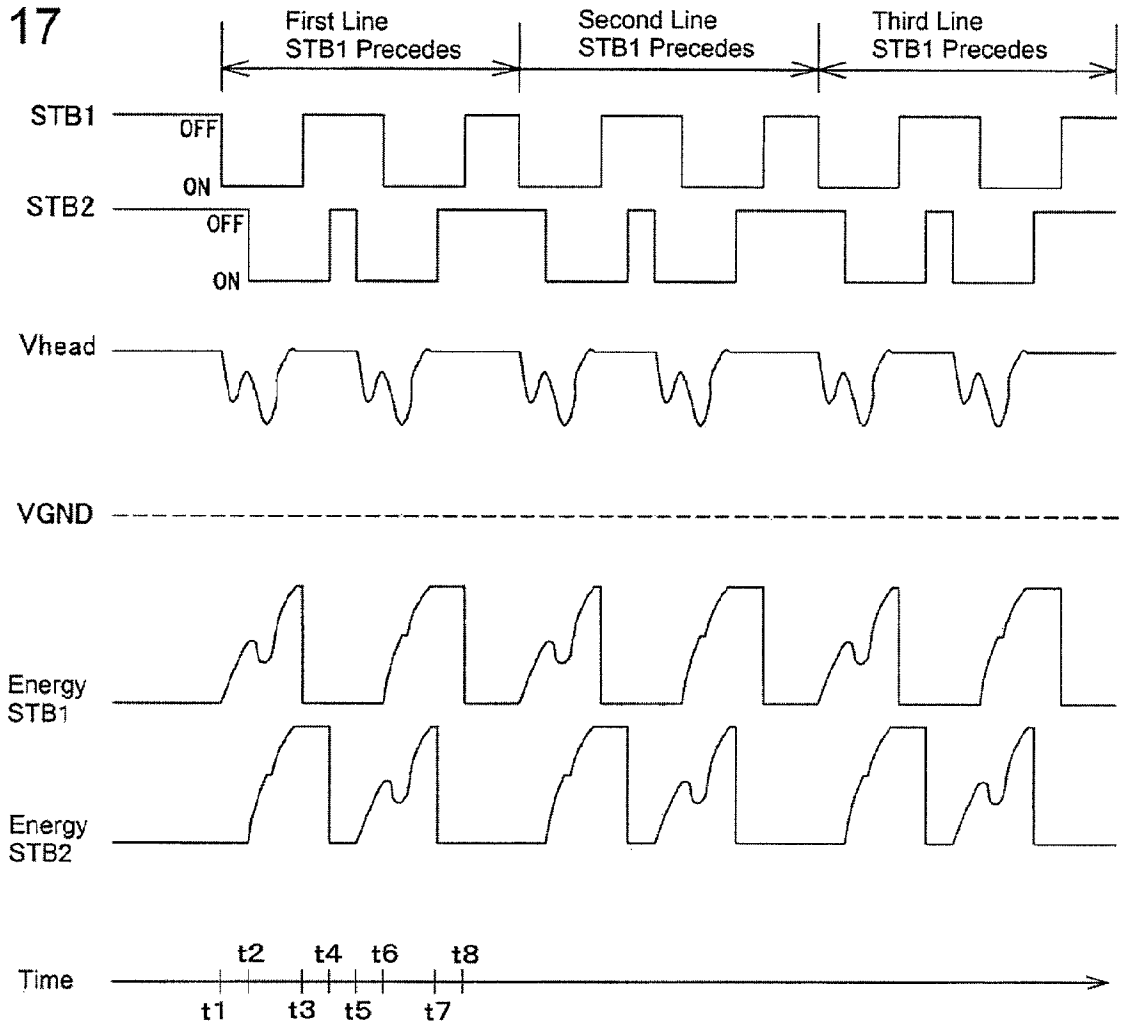
FIG. 17 is a timing chart of Embodiment 2 showing the relationship among a first strobe signal, second strobe signal, thermal head applied voltage, thermal head ground voltage, supply energy to heater elements with the first strobe signal, and supply energy to heater elements with the second strobe signal.

As shown in FIG. 17, for the printing processing of the first printing line, the first strobe signal STB1 is switched to the ON state at time t1, and the second strobe signal STB2 is switched to the ON state at time t2. The first strobe signal STB1 is switched to the OFF state at time t3, and the second strobe signal STB2 is switched to the OFF state at time t4. Subsequently, the second strobe signal STB2 is switched to the ON state again at time t5, and the first strobe signal STB1 is also switched to the ON state again at time t6. Then, the second strobe signal STB2 is switched to the OFF state at time t7, and the first strobe signal STB1 is switched to the OFF state at time t8. For printing processing of the second and subsequent printing lines, the first strobe signal STB1 and second strobe signal STB2 are controlled in ON/OFF in the same manner as in the printing processing of the first printing line.

The timing chart of FIG. 17 differs from the timing chart as shown in FIG. 15 in the following two points: (a) The first strobe signal STB1 and the second strobe signal STB2 have a plurality of current passage pulses for switching passage of current through heater elements belonging to the odd-numbered blocks and heater elements belonging to the even-numbered blocks as shown in FIG. 13 to the ON state for the printing processing of one printing line; and (b) irrespective of printing lines, the first strobe signal STB1 is a strobe signal which is first switched to the ON state between the first strobe signal STB1 and the second strobe signal STB2. Then, the charts are the same in meeting three current passage conditions (1) to (3) as described in Embodiment 1.

In addition, in Embodiment 2, the CPU executes the printing processing different from the printing processing shown in the flowchart (FIG. 16) as shown in Embodiment 1, and by referring to FIG. 16, the printing processing executed by the CPU in the timing chart as shown in FIG. 17 is clarified, and therefore, is omitted.

(Embodiment 3)

Described next is Embodiment 3 in which the present invention is applied to a printing apparatus. Embodiment 3 is an aspect in which the first strobe signal STB1 and the second strobe signal STB2 have a plurality of current passage pulses for switching passage of current through heater elements belonging to the odd-numbered blocks and heater elements belonging to the even-numbered blocks as shown in FIG. 13 to the ON state for the printing processing of one printing line, and a strobe signal to which a current passage pulse that is first switched to the ON state belongs is different between the first strobe signal STB1 and the second strobe signal STB2 for each printing line, and is the aspect suitable for gray scale expression. In addition, the case will be described below where each of the first strobe signal STB1 and the second strobe signal STB2 has three current passage pulses for the printing processing of one printing line.

Figure 18:
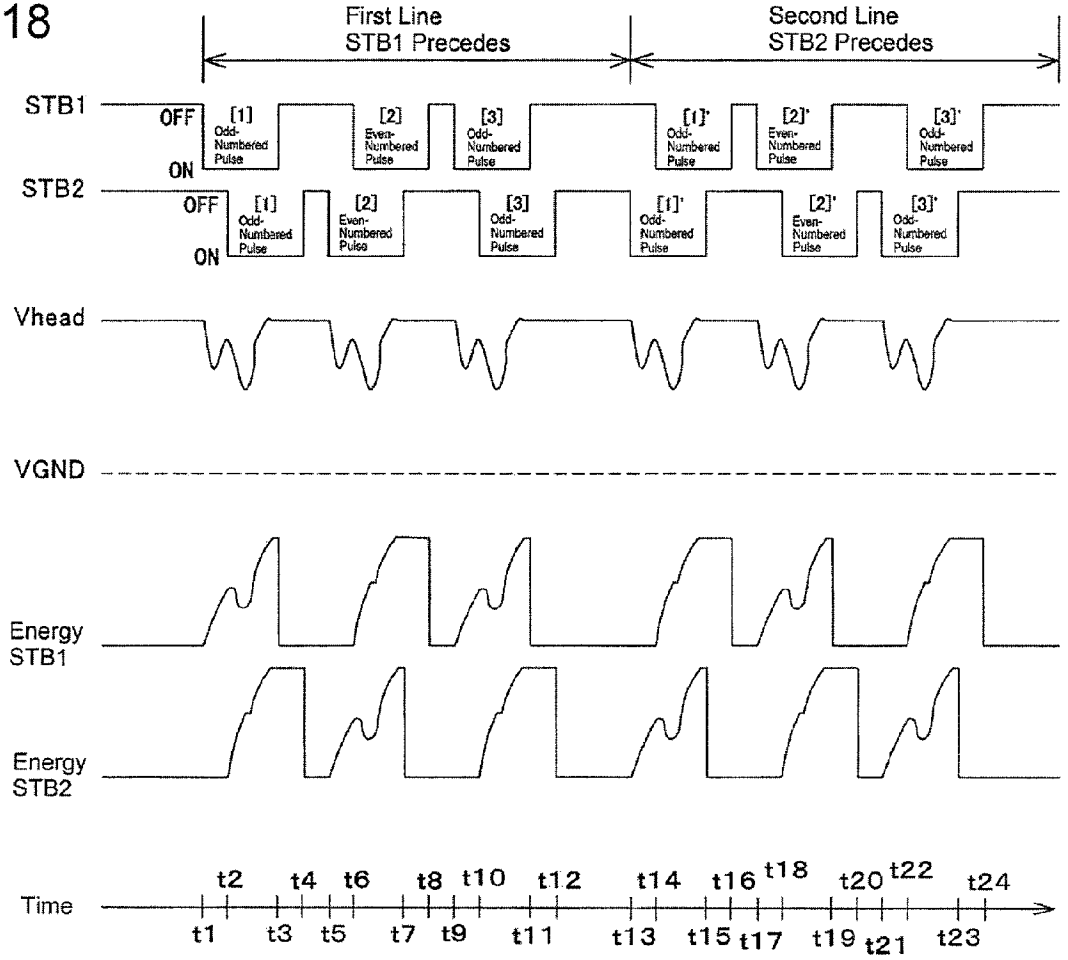
FIG. 18 is a timing chart of Embodiment 3 showing the relationship among a first strobe signal, second strobe signal, thermal head applied voltage, thermal head ground voltage, supply energy to heater elements with the first strobe signal, and supply energy to heater elements with the second strobe signal.

As shown in FIG. 18, for the printing processing of the first printing line, the first strobe signal STB1 is switched to the ON state at time t1, and the second strobe signal STB2 is switched to the ON state at time t2. The first strobe signal STB1 is switched to the OFF state at time t3, and the second strobe signal STB2 is switched to the OFF state at time t4. In other words, the first current passage pulse of the first strobe signal STB1 is switched to the ON state at time t1, and is switched to the OFF state at time t3, and the first current passage pulse of the second strobe signal STB2 is switched to the ON state at time t2, and is switched to the OFF state at time t4. These two current passage pulses are odd-numbered current passage pulses of the odd-numbered printing line. Subsequently, the second strobe signal STB2 is switched to the ON state again at time t5, the first strobe signal STB1 is also switched to the ON state again at time t6, the second strobe signal STB2 is switched to the OFF state again at time t7, and the first strobe signal STB1 is also switched to the OFF state again at time t8. In other words, the second current passage pulse of the second strobe signal STB2 is switched to the ON state at time t5, and is switched to the OFF state at time t7, and the second current passage pulse of the first strobe signal STB1 is switched to the ON state at time t6, and is switched to the OFF state at time t8. These two current passage pulses are even-numbered current passage pulses of the odd-numbered printing line. Further, the first strobe signal STB1 is switched to the ON state for the third time at time t9, the second strobe signal STB2 is also switched to the ON state for the third time at time t10, the first strobe signal STB1 is switched to the OFF state for the third time at time t11, and the second strobe signal STB2 is also switched to the OFF state for the third time at time t12. In other words, the third current passage pulse of the first strobe signal STB1 is switched to the ON state at time t9, and is switched to the OFF state at time t11, and the third current passage pulse of the second strobe signal STB2 is switched to the ON state at time t10, and is switched to the OFF state at time t12. These two current passage pulses also correspond to odd-numbered current passage pulses of the odd-numbered printing line.

For the printing processing of the second printing line, the second strobe signal STB2 is switched to the ON state at time t13, and the first strobe signal STB1 is switched to the ON state at time t14. The second strobe signal STB2 is switched to the OFF state at time t15, and the first strobe signal STB1 is switched to the OFF state at time t16. In other words, for the printing processing of the second printing line, the first current passage pulse of the second strobe signal STB2 is switched to the ON state at time t13, and is switched to the OFF state at time t15, and the first current passage pulse of the first strobe signal STB1 is switched to the ON state at time t14, and is switched to the OFF state at time t16. These two current passage pulses are odd-numbered current passage pulses of the even-numbered printing line. Subsequently, the first strobe signal STB1 is switched to the ON state again at time t17, the second strobe signal STB2 is also switched to the ON state again at time t18, the first strobe signal STB1 is switched to the OFF state again at time t19, and the second strobe signal STB2 is also switched to the OFF state again at time t20. In other words, for the printing processing of the second printing line, the second current passage pulse of the first strobe signal STB1 is switched to the ON state at time t17, and is switched to the OFF state at time t19, and the second current passage pulse of the second strobe signal STB2 is switched to the ON state at time t18, and is switched to the OFF state at time t20. These two current passage pulses are even-numbered current passage pulses of the even-numbered printing line. Further, the second strobe signal STB2 is switched to the ON state for the third time at time t21, the first strobe signal STB1 is also switched to the ON state for the third time at time t22, the second strobe signal STB2 is switched to the OFF state for the third time at time t23, and the first strobe signal STB1 is also switched to the OFF state for the third time at time t24. In other words, for the printing processing of the second printing line, the third current passage pulse of the second strobe signal STB2 is switched to the ON state at time t21, and is switched to the OFF state at time t23, and the third current passage pulse of the first strobe signal STB1 is switched to the ON state at time t22, and is switched to the OFF state at time t24. These two current passage pulses also correspond to odd-numbered current passage pulses of the even-numbered printing line. The above-mentioned processing is repeated for the printing processing of the third and subsequent printing lines.

The timing chart of FIG. 18 differs from the timing chart as shown in FIG. 15 in the respect that the first strobe signal STB1 and the second strobe signal STB2 have a plurality of current passage pulses for switching passage of current through heater elements belonging to the odd-numbered blocks and heater elements belonging to the even-numbered blocks as shown in FIG. 13 to the ON state for the printing processing of one printing line, and differs from the timing chart as shown in FIG. 17 in the respect that a strobe signal that is first switched to the ON state is different between the first strobe signal STB1 and the second strobe signal STB2 for each printing line.

The printing processing executed by the CPU of the printing apparatus 1 of Embodiment 3 will be described next. In addition, to deepen understanding, the relationship with the time of the timing chart as shown in FIG. 18 will also be described.

Figure 19:
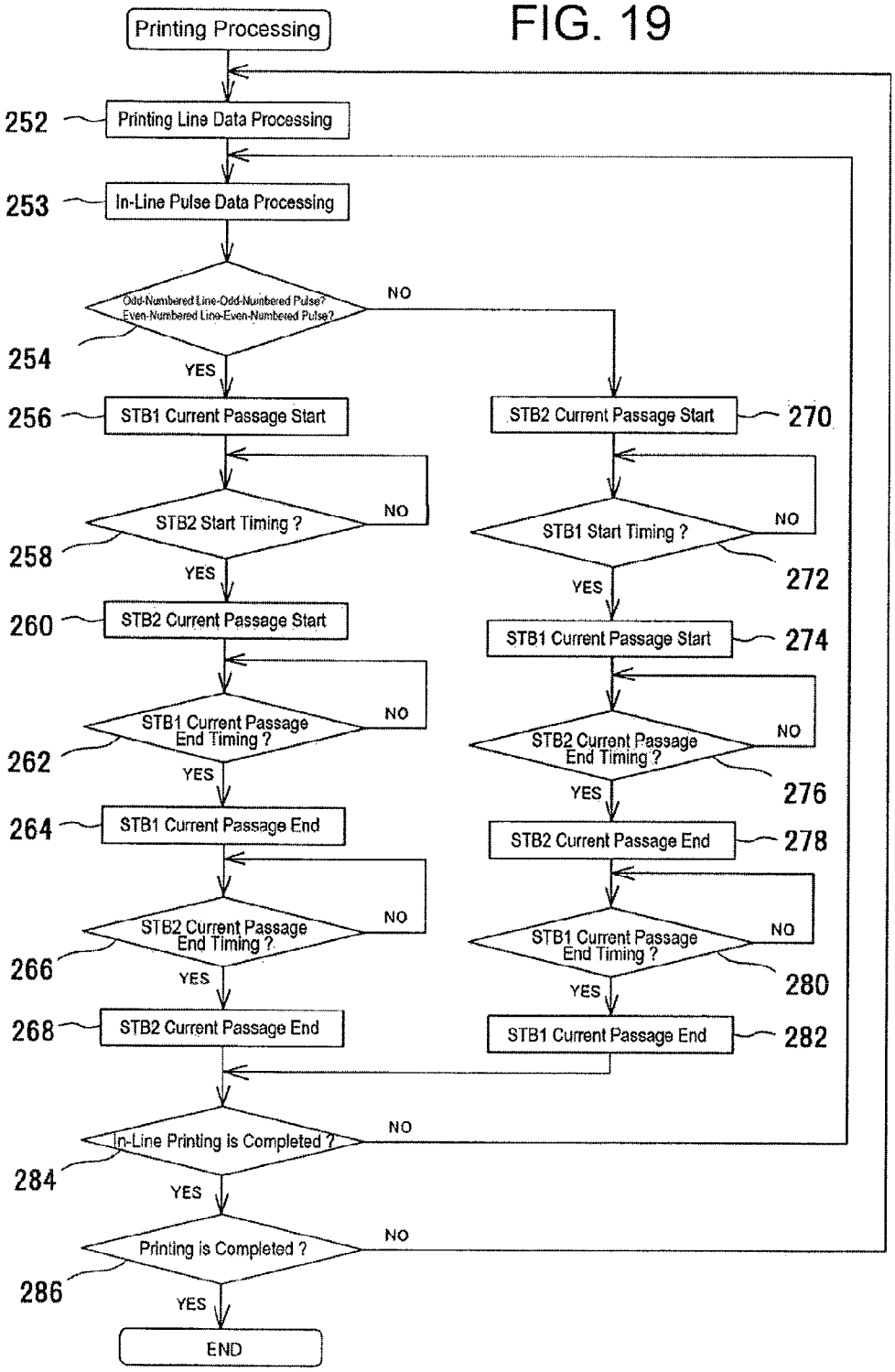
FIG. 19 is a flowchart of a printing processing routine executed by a CPU of a control section in a printing apparatus of Embodiment 3.

As shown in FIG. 19, the CPU executes printing line data processing in step 252. In the printing line data processing, in the same manner as in the processing of step 202 in FIG. 16, the CPU generates each printing line data. Then, the CPU generates pulse data corresponding to each dot in the printing line for gray scale expression to output to the shift register SR of the thermal head 40 (step 253). By repeating this step of generating pulse data to print 256 times, it is possible to provide 256-level gray scale expression. In addition, in the case of expressing 256-level gray scale in one pixel (dot), it is not always necessary to make the number of current passage pulses "256", and for example, maximum 20 current passage pulses may be used. In this case, in order to determine the number of current passage pulses corresponding to gray scale, a table for determining the relationship between gray scale and the number of pulses may be referred to, or the number of current passage pulses may be calculated by applying an equation. In this case, for example, for gray scale of intermediate extent, the number of current passage pulses may be determined or calculated as "(about) 10". In addition, in the following description, the case will be described where the number of current passage pulses of the first printing line is "3" in response to FIG. 18.

In next step 254, the CPU determines whether or not the processing is on an odd-numbered printing line with an odd-numbered current passage pulse or an even-numbered printing line with an even-numbered current passage pulse, and in the case of a positive determination, as can be seen from FIG. 18, since the first strobe signal STB1 is switched to the ON state earlier than the second strobe signal STB2, in step next step 256, switches the first strobe signal STB1 to the ON state (for example, time t1 in FIG. 18). In addition, the odd-numbered printing line with the odd-numbered current passage pulse corresponds to [1], [3] in FIG. 18, the odd-numbered printing line with the even-numbered current passage pulse corresponds to [2] in FIG. 18, the even-numbered printing line with the odd-numbered current passage pulse corresponds to [1]', [3]' in FIG. 18, and the even-numbered printing line with the even-numbered current passage pulse corresponds to [2]' in FIG. 18. Next, in step 258, the CPU determines whether or not timing is current passage start timing (for example, time t2 in FIG. 18) for switching the second strobe signal STB2 to the ON state, and in a negative determination, waits, while in a positive determination, switching the second strobe signal STB2 to the ON state in next step 260.

Next, in step 262, the CPU determines whether or not timing is current passage end timing (for example, time t3 in FIG. 18) for switching the first strobe signal STB1 to the OFF state, and in a negative determination, waits, while in a positive determination, switching the first strobe signal STB1 to the OFF state in next step 264. In next step 266, the CPU determines whether or not timing is current passage end timing (for example, time t4 in FIG. 18) for switching the second strobe signal STB2 to the OFF state, and in a negative determination, waits, while in a positive determination, switching the second strobe signal STB2 to the OFF state in next step 268 to proceed to step 284.

Meanwhile, in the case where the determination in step 254 is negative, as can be seen from FIG. 18, since the second strobe signal STB2 is switched to the ON state earlier than the first strobe signal STB1, in step 270, the CPU switches the second strobe signal STB2 to the ON state (for example, time t5 in FIG. 18). Next, in step 272, the CPU determines whether or not timing is current passage start timing (for example, time t6 in FIG. 18) for switching the first strobe signal STB1 to the ON state, and in a negative determination, waits, while in a positive determination, switching the first strobe signal STB1 to the ON state in next step 274.

Next, in step 276, the CPU determines whether or not timing is current passage end timing (for example, time t7 in FIG. 18) for switching the second strobe signal STB2 to the OFF state, and in a negative determination, waits, while in a positive determination, switching the second strobe signal STB2 to the OFF state in next step 278. In next step 280, the CPU determines whether or not timing is current passage end timing (for example, time t8 in FIG. 18) for switching the first strobe signal STB1 to the OFF state, and in a negative determination, waits, while in a positive determination, switching the first strobe signal STB1 to the OFF state in next step 282 to proceed to step 284.

In step 284, the CPU determines whether or not printing of printing processing targeted lines is completed. In this Embodiment, since the number of current passage pulses per printing line is "3", the processing of steps 254 to 282 is repeated three times. Ina negative determination, the CPU returns to step 254 to perform the processing with a next current passage pulse. In a positive determination, in next step 286, the CPU determines whether or not printing is completed i.e. whether or not the processing of all printing lines is completed, and in a negative determination, returns to step 252 to output the next printing line data to the shift register SR of the thermal head 40, and determines/calculates the number of current passage pulses to perform the printing processing of the next printing line. Meanwhile, in a positive determination, the CPU finishes the printing processing.

In addition, as described above, the first strobe signal STB1 and the second strobe signal STB2 of the timing chart as shown in FIG. 18 are suitable for gray scale expression. Accordingly, there is the case where the number of current passage pulses is intentionally varied for each printing line for gray scale expression. Then, when the number of current passage pulses is the same for each printing line as described above, as shown in FIG. 20B, although the unevenness of concentration occurs in the pixel (dot) level, since light and dark is mixed evenly, it seems there is no unevenness of concentration when viewed with the human eye. This respect is clarified by referring to supply energy (integrated value of passage of current) to heater elements with the first strobe signal STB1 and supply energy (integrated value of passage of current) to heater elements with the second strobe signal STB2 as shown in FIG. 18. Accordingly, Embodiment 3 basically meets also three current passage conditions (1) to (3) as described in Embodiment 1.

Figure 20C:
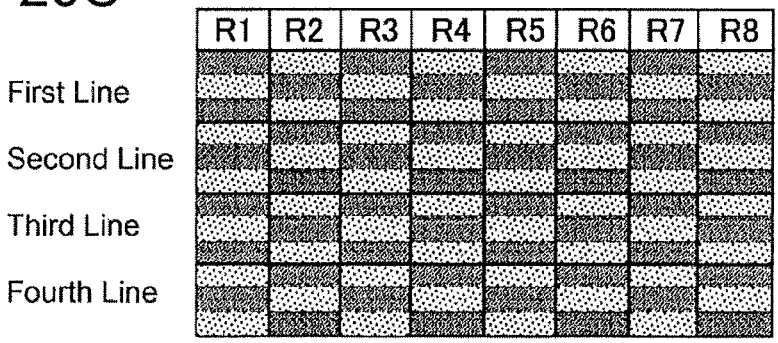
Figure 21:
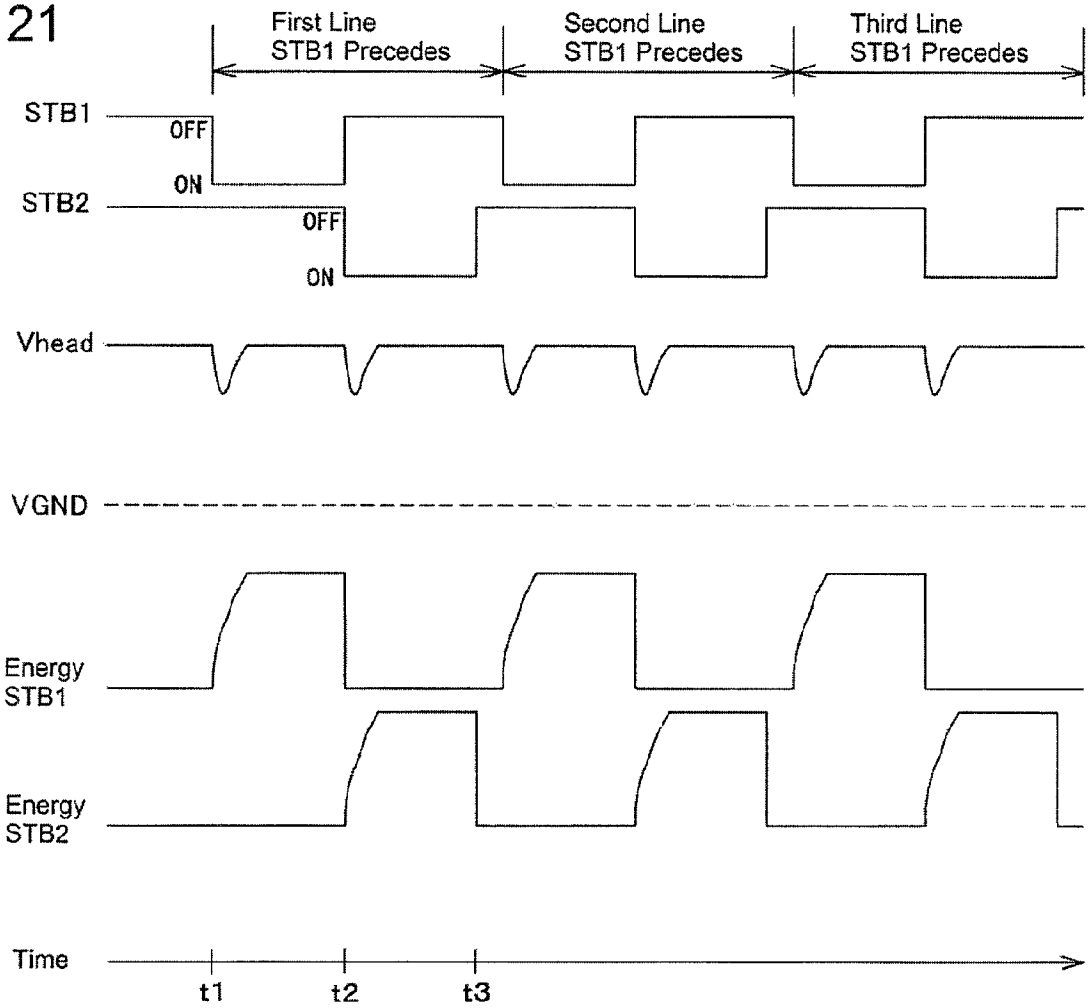
FIG. 21 is a timing chart of conventional techniques showing the relationship among a first strobe signal, second strobe signal, thermal head applied voltage, thermal head ground voltage, supply energy to heater elements with the first strobe signal, and supply energy to heater elements with the second strobe signal.

FIG. 20C schematically shows a printing state of the first to fourth printing lines with heater elements R 1 to R 8 in the case of performing current passage control as shown in FIG. 18 with the block circuit diagram of FIG. 14. When the diagram is seen, since light and dark is mixed evenly finer than FIG. 20B, it seems there is no unevenness of concentration when viewed with the human eye.

In addition, the above-mentioned Embodiments show the examples in which the present invention is applied to the indirect printing type printing apparatus 1, but the invention is not limited thereto, and is applicable to the direct printing type printing apparatus 1. Further, the card is exemplified as the recording medium, but the invention is not limited thereto, and for example, is applicable to a long recording medium, circular (elliptical) recording medium, polygon-shaped recording medium, film-shaped recording medium, paper-shaped recording medium and thick recording medium.

Further, the above-mentioned Embodiments show the examples where seven strobe input ports are provided in association with IC1 to IC7 and heater elements are divided into the first to seventh flocks, but the present invention is not limited thereto, and it is essential only that the thermal head 40 is provided with two or more strobe signal input ports so as to input the first strobe signal STB1 and the second strobe signal STB2. Further, the number of ICs is not limited to "7", and for example, when one IC is capable of supporting, it is not necessary to divide into the first to seventh blocks.

Figure 23:
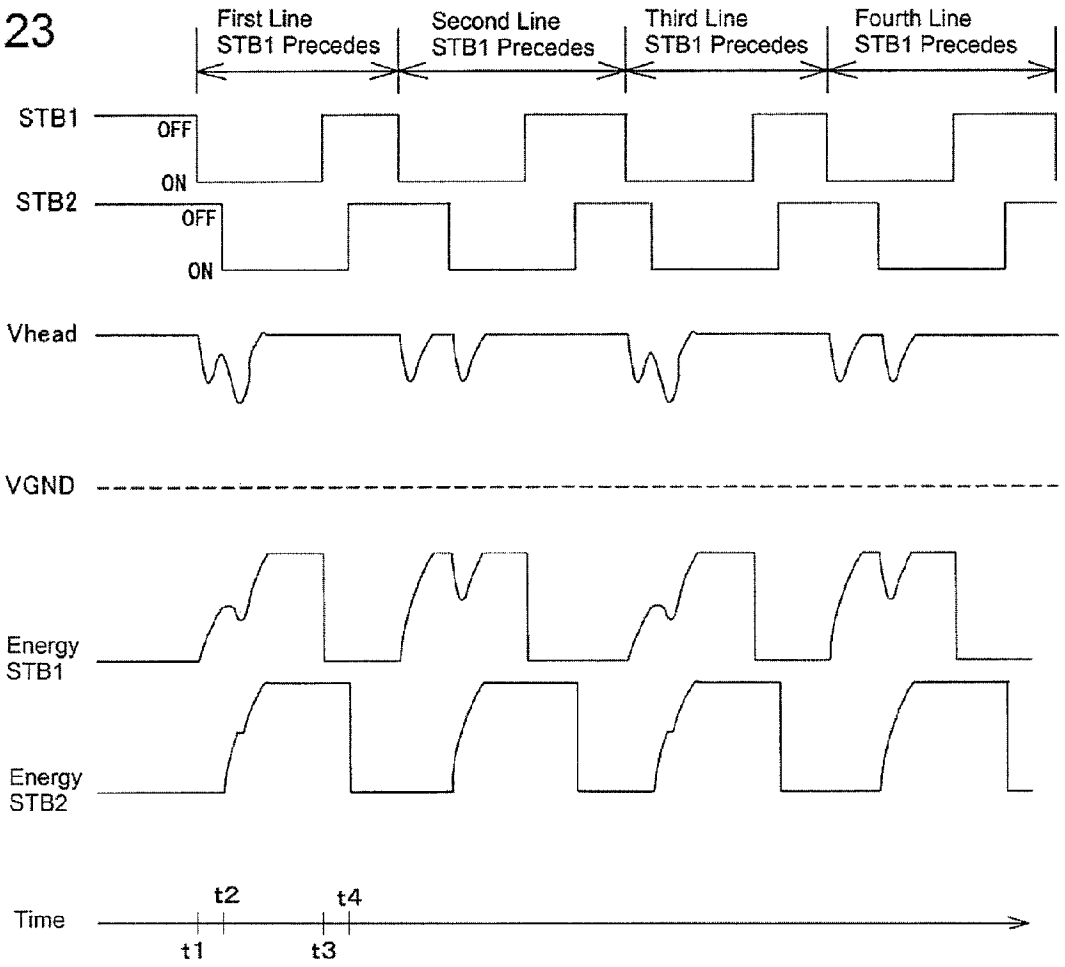
FIG. 23 is a reference timing chart showing the relationship among a first strobe signal, second strobe signal, thermal head applied voltage, thermal head ground voltage, supply energy to heater elements with the first strobe signal, and supply energy to heater elements with the second strobe signal.
Figure 25:
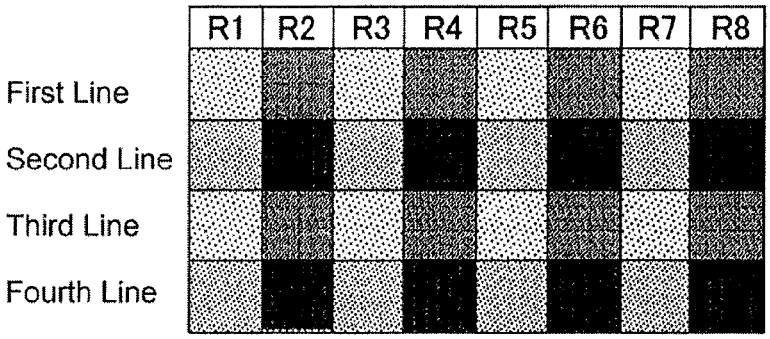
FIG. 25 schematically shows a printing state of first to fourth printing lines with eight heater elements among heater elements lined up in the main scanning direction, and corresponds to current passage control as shown in FIG. 23.

Moreover, although not within the scope of the present invention, as shown in FIG. 23, current control may be performed so that for the printing processing of the first printing line, the first strobe signal STB1 is switched to the ON state at time t1, the second strobe signal STB2 is switched to the ON state at time t2, the first strobe signal STB1 is switched to the OFF state at time t3, the second strobe signal STB2 is switched to the OFF state at time t4, and that for the second and subsequent printing lines, ON/OFF is performed similarly. In this reference example, although (1) and (2) among three current passage conditions as shown in Embodiment 1 are met, with respect to (3), the sum of an integrated value of current passed through heater elements belonging to the odd-numbered blocks as shown in FIG. 13 in printing processing of an odd-numbered printing line (for example, first printing line) and an integrated value of current passed through heater elements belonging to the odd-numbered blocks as shown in FIG. 13 in printing processing of an even-numbered printing line (for example, second printing line) is slightly different from the sum of an integrated value of current passed through heater elements belonging to the even-numbered blocks as shown FIG. 13 in printing processing of the odd-numbered printing line (for example, first printing line) and an integrated value of current passed through the heater elements to the even-numbered blocks as shown in FIG. 13 in printing processing of the even-numbered printing line (for example, second printing line), and the unevenness of concentration slightly degrades, but in the case of seeing with the human eye, it seems that the unevenness of concentration of such an extent does not occur (see FIG. 25).

Figure 24:
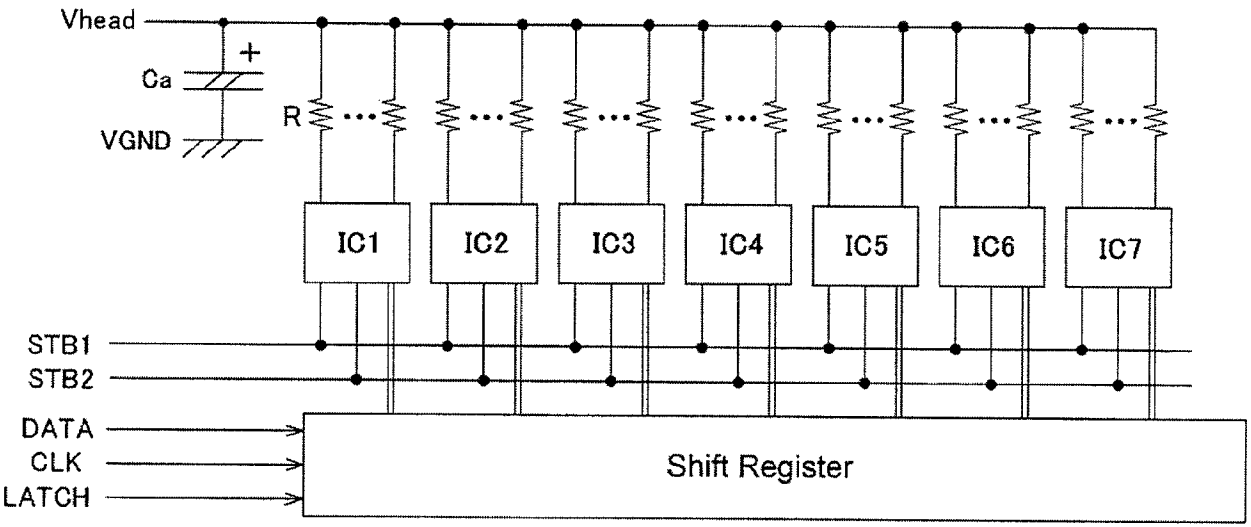
FIG. 24 is a reference block circuit diagram showing a thermal head current passage control circuit.

Then, although not within the scope of the invention similarly, the thermal head current passage control circuit may be configured as shown in FIG. 24. This reference example is an example in which eight heater elements R1 to R8 are increased to 192, for example, and 192 heater elements are grouped to one block to process with one IC.

In addition, this application claims priority from Japanese Patent Application No. 2013-062551 incorporated herein by reference.

The invention claimed is:

1. A printing apparatus for performing printing processing on a recording medium with a thermal head via an ink ribbon, comprising:

a thermal head having a plurality of heater elements lined up in a main scanning direction; and a current passage control device switching current passage timing of the plurality of heater elements, wherein the current passage control device controls a first strobe signal for switching between ON and OFF of passage of current through a part of the plurality of heater elements and a second strobe signal for switching between ON and OFF of passage of current through the other part of the plurality of heater elements, so that current passage time periods for switching passage of current through the part and the other part of the plurality of heater elements to an ON state partially overlap and that in printing data of a same concentration over a plurality of lines with the part of the plurality of heater elements and the other part of the plurality of heater elements, a sum of an integrated value of current passed through the part of the plurality of heater elements in printing processing of an odd-numbered printing line and an integrated value of current passed through the part of the plurality of heater elements in printing processing of an even-numbered printing line is the same as a sum of an integrated value of current passed through the other part of the plurality of heater elements in printing processing of the odd-numbered printing line and an integrated value of current passed through the other part of the plurality of heater elements in printing processing of the even-numbered printing line.

2. The printing apparatus according to claim 1, wherein the current passage control device controls the first strobe signal and the second strobe signal so that current passage start timing for switching passage of current through the part and the other part of the plurality of heater elements to the ON state is temporally different completely from current passage end timing for switching passage of current through the part and the other part of the plurality of heater elements to an OFF state.

3. The printing apparatus according to claim 1, wherein the plurality of heater elements is comprised of a plurality of blocks divided in the main scanning direction, and the current passage control device controls passage of current through a heater element of an odd-numbered block at the same timing as the first strobe signal, and controls passage of current through a heater element of an even-numbered block at the same timing as the second strobe signal.

4. The printing apparatus according to claim 1, wherein the current passage control device switches the current passage timing for the part and the other part of the plurality of heater elements so that the second strobe signal is switched to the ON state after switching the first strobe signal to the ON state, after switching the second strobe signal to the ON state the first strobe signal is switched to an OFF state, the second strobe signal is switched to an OFF state, then the first strobe signal is switched to the ON state after switching the second strobe signal to the ON state, after switching the first strobe signal to the ON state the second strobe signal is switched to the OFF state, and that the first strobe signal is switched to the OFF state.

5. The printing apparatus according to claim 1, wherein the first strobe signal and the second strobe signal have a plurality of current passage pulses to switch passage of current through the part and the other part of the plurality of heater elements to the ON state for printing processing of one printing line.

6. The printing apparatus according to claim 1, wherein the first strobe signal and the second strobe signal have a plurality of current passage pulses to switch passage of current through the part and the other part of the plurality of heater elements to the ON state for printing processing of one printing line, and the current passage control device controls so that the strobe signal to which a current passage pulse that is first switched to the ON state belongs is different between the first strobe signal and the second strobe signal for each printing line.

* * * * *